United States Patent [19]

Agbay et al.

[11] Patent Number: 4,512,485

[45] Date of Patent: Apr. 23, 1985

[54] TAMPER RESISTANT AND TAMPER EVIDENT CLOSURES

[75] Inventors: Albert J. Agbay, Worcester, Mass.; Ralph H. Thomas, Sr., Clark, N.J.

[73] Assignee: Robert Linkletter Associates, Inc., Westboro, Mass.

[21] Appl. No.: 594,723

[22] Filed: Mar. 29, 1984

[51] Int. Cl.[3] ..... B65D 55/02

[52] U.S. Cl. ..... 215/225; 220/221

[58] Field of Search ..... 215/221, 224, 225, 223, 215/325, 274; 220/319

[56] References Cited

U.S. PATENT DOCUMENTS

| | | | |
|---|---|---|---|
| 3,469,725 | 9/1969 | Turner | 215/225 |
| 3,811,589 | 5/1974 | Thornton et al. | 215/225 |
| 3,901,400 | 8/1975 | Westfall | 215/221 |

*Primary Examiner*—George T. Hall

*Attorney, Agent, or Firm*—Blakely, Sokoloff, Taylor & Zafman

[57] ABSTRACT

Safety closures resistant to tampering comprising a cap, a rotary safety ring, and a locking member, usually located below the rotary safety ring, said closure requiring that the locking member be removed before the safety ring can be lowered; the safety ring must be aligned with the cap in one angular position and pushed downwardly away from the cap in one angular position and pushed downwardly away from the cap before the cap can be removed from the container. The locking member includes a first engaging means which engages a second engaging means located on the neck of the container to which the safety closure is attached. The locking member, prevented from rotation by the engagement of the first and second engaging means, is attached to the rotary safety ring by a connection, which should be broken whenever the closure has been tampered with. The connection may be a fragile tear pin, or a peel pin. A tamper resistant safety closure comprising a snap cap, capable of being removed only when a thumb tab extends past an annular ridge, that engages (via, e.g. a peg or a breakable arm) a snap off ring that is prevented from rotating by engaging the annular ridge; the breakable arm or peg resists tampering. A tamper resistant safety closure comprising a cap and a rotary safety ring and a cylindrical sheath, being peelably attached to the safety ring and preventing the safety ring from being lowered as long as the sheath is between the safety ring and a circumferential shoulder.

20 Claims, 27 Drawing Figures

Fig. 23
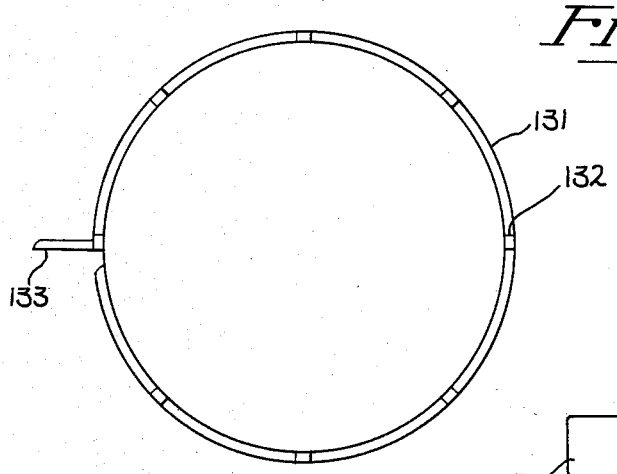
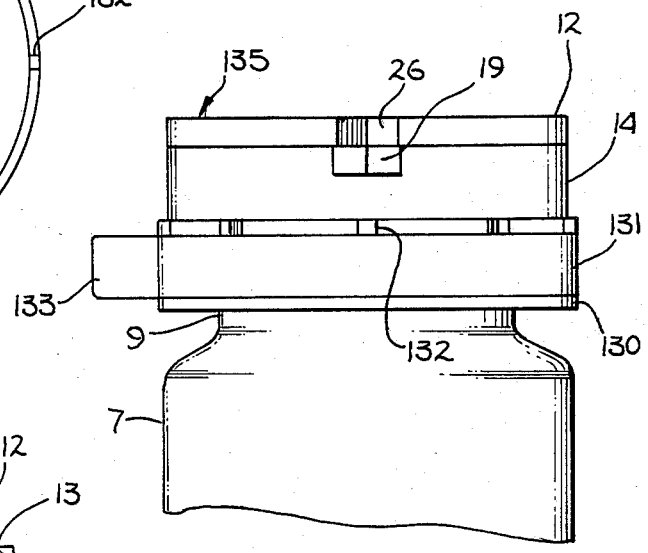
Fig. 24
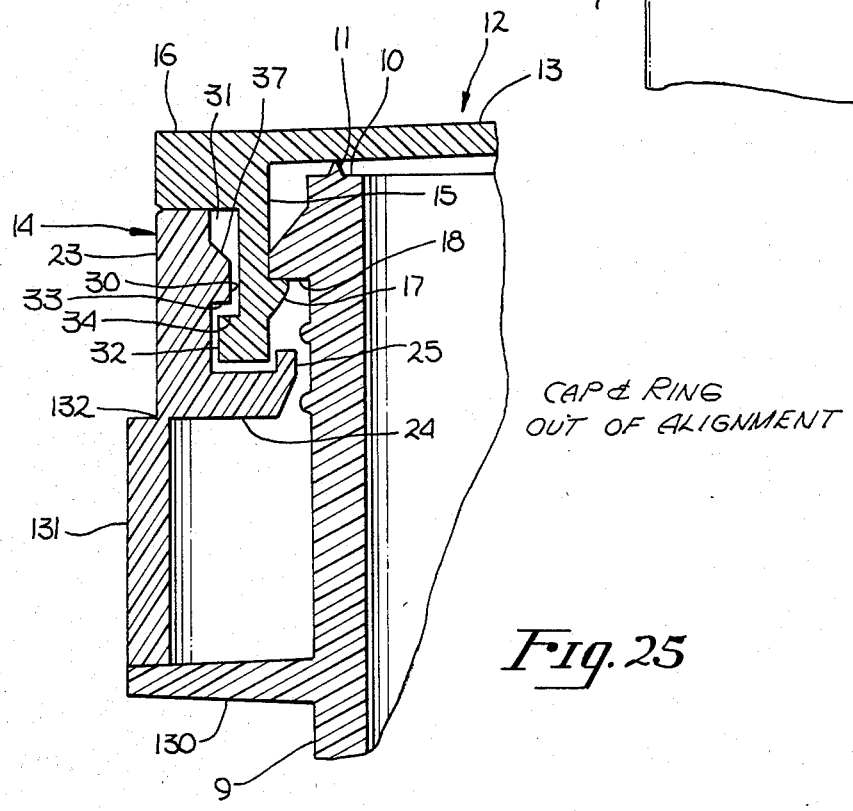
Fig. 25

TAMPER RESISTANT AND TAMPER EVIDENT CLOSURES

BACKGROUND OF THE INVENTION

1. Field of the Invention

This invention relates to safety closure containers and has particular reference to closures having tamper resistant and tamper evident features. Some of the closures disclosed herein are also child resistant closures because they tend to prevent children from readily opening the containers.

2. Prior Art

Various safety closures are described in the prior art, such as the safety closures described in U.S. Pat. Nos. 3,612,322 and 3,693,820. These safety closures comprise a snap-on cap held in place on a container by a rotary safety ring which must be aligned with the cap and pushed downwardly away from the cap before one can remove the cap from the container. There is only one angular position in which the rotary safety ring can be removed from the cap. The ring is locked around a portion of the cap by fingers, which extend from either inside of the ring or from the cap and which fingers fit into a locking groove formed between the ring and the cap. The ring is unlocked by aligning it with the cap in one angular position so that the fingers slide through release grooves in the locking groove when the ring is pulled downwardly away from the cap. While these safety closures have generally worked well, they are particularly prone to tampering because the consumer has no way of knowing whether the container has been opened or otherwise tampered with. It is an object of this invention to provide closures which are resistant to tampering and provide evidence of tampering.

SUMMARY OF THE INVENTION

The present invention provides a safety closure having a snap-on cap ("snap cap") or a screw-on cap ("screw cap") held in place on a container by a rotary safety ring which must be aligned with the cap in one angular position and pushed downwardly away from the cap before one can remove the cap from the container. The safety ring is locked around the portion of the cap by fingers, which usually extend from the inside of the safety ring, and which fingers fit into a locking groove formed between the safety ring and the cap. The safety ring is unlocked by aligning it with the cap in one angular position so that the fingers slide through the release grooves in the locking groove when the safety ring is pulled downwardly away from the cap. The present invention includes a locking member located below the rotary safety ring. The locking member includes a first engaging means which engages a second engaging means located on the neck; the engagement of the first and second engaging means prevents the locking member from being rotated relative to the container. A connection is provided between the rotary safety ring and the locking member thereby preventing the safety ring from being rotated. Thus, when the rotary safety ring is locked around a portion of the cap by the fingers and is out of alignment with the cap, the cap cannot be removed without breaking the connection. A missing connection will indicate that the closure has been opened or otherwise tampered with.

The locking member may be in the form of a portion of a second ring or a whole second ring encircling the neck below the rotary safety ring. The connection may be a fragile tear pin connecting the second ring to the rotary safety ring. The fragile tear pin is constructed so that it will tear when the rotary safety ring is rotated relative to the second ring. The first and second engaging means may be a plurality of teeth located on the inside portion of the second ring and on the neck respectively. This embodiment of the present invention also works well with a screw cap rather than a snap cap.

The present invention also provides a safety closure of the type disclosed above wherein the connection is a peel pin which is resistant to breaking when the rotary safety ring is rotated relative to the locking member, called in this embodiment a tear strip. The peel pin will allow the tear strip to be peeled from the rotary safety ring and thereby allow the cap to be removed. In this particular embodiment, the closure can not be opened without peeling the tear strip from the rotary safety ring. It will be noted that since the tear strip must be removed before these closures, whether using a snap cap or a screw on cap, can be opened, the tear strip makes these closures both tamper evident and tamper resistant. That is, evidence of tampering will be indicated by the missing tear strip and the closure is resistant to tampering because the tear strip must be removed first before one can open the container for the first time.

Another embodiment of the present invention provides a snap cap which has a depending annular flange projecting below the top of the cap, which flange has an inwardly directed circumferential bead which engages a lip on the container. This flange also has an outwardly directed thumb tab, used to allow one's thumb to push the cap off the container. The thumb tab of the snap cap sits directly over an annular ridge located on the neck of the container. The annular ridge has an indented portion allowing the thumb tab to extend out beyond the annular ridge, which resembles a shelf surrounding the neck, so that one may apply an upwardly directed force to the cap to remove the cap from the container. Since the only bottom portion of the cap which is exposed is the outwardly directed thumb tab when that tab is positioned over the indented portion of the annular ridge, the snap cap can not be removed from the container unless the thumb tab is positioned over the indented portion. A snap off ring, which encircles the neck and which has a first engaging means, is connected to the snap cap by a breakable arm. The annular ridge on the neck of the container includes a second engaging means which engages the first engaging means located on the snap off ring thereby preventing rotation of the snap off ring relative to the container. The breakable arm resists rotation of the snap cap, but will not prevent it, as it designed to break when one forcefully rotates either the snap cap or the snap off ring. The snap off ring may be positioned under the annular ridge so that the closure can not be opened without breaking the breakable arm. In this way, the breakable arm will indicate that the closure has been tampered with when that arm is broken.

In a similar embodiment of the present invention, a peg connecting the snap off ring to the snap cap may be used in place of the breakable arm. The peg is constructed so that it is resistant to breaking but will allow the snap off ring to be peeled from the snap cap, usually at the peg. In this particular embodiment, the snap cap can not be removed without first removing the snap off ring by peeling that ring off. Thus, a missing snap off ring or peel pin indicates that the closure has been tampered with; moreover, the closure is resistant to tampering because the snap off ring must be peeled off before the closure can be opened.

This invention also provides a tamper evident and tamper resistant safety closure, which may be used for glass or plastic containers, which includes the snap cap ("snap cap") or a screw cap ("screw cap") and the rotary safety ring described above. This closure also includes a cylindrical sheath which encircles the neck of the container below the rotary safety ring, which cylindrical sheath is breakably attached by a peel pin to the rotary safety ring. This peel pin allows the sheath to be peeled away from the rotary safety ring. The cylindrical sheath being located between the rotary safety ring and a circumferential shoulder which projects outwardly from the neck prevents the rotary safety ring from being lowered as long as the cylindrical sheath is attached to the rotary safety ring. This closure can not be opened without removing the cylindrical sheath. Thus, the missing cylindrical sheath will evidence that the bottle has been opened or otherwise tampered with; furthermore, this closure is tamper resistant because the sheath, which provides resistance against the first opening, must be removed.

The following detailed description, together with the drawings, will illustrate by way of example the features and advantages of the present invention.

DESCRIPTION OF THE DRAWINGS

FIG. 23 is a horizontal cross-sectional view of the safety closure shown in FIG. 24, that view taken substantially at the junction of the cylindrical sheath 131 and the peel pins 132.

FIG. 24 shows a safety closure having a cylindrical sheath between the rotary safety ring and a circumferential shoulder 130.

FIG. 25 shows a vertical cross-sectional view of the safety closure in FIG. 24 out of alignment.

DETAILED DESCRIPTION OF THE INVENTION

Figure 1:
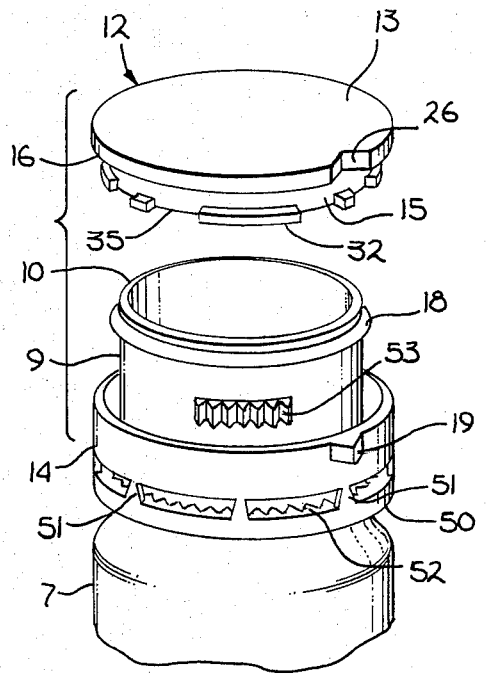
FIG. 1 is an exploded view of a safety closure having a locking member, the second ring 50.

Referring to FIG. 1, safety closure 5, designed for a container 7 having a neck 9 and a rim 10 defining an open mouth, general comprises a flexible snap-on cap ("snap cap") 12 covering the mouth of the container and a rotary safety ring ("safety ring") 14 which holds the cap on the container when the container overlies a portion of the cap.

To better define this invention, the following words will be explained. Longitudinal (and longitudinally), as used to describe and claim this invention, means along the length of the container; that is, along a line extending from the cap through the ring and down to the neck to the bottom of the container. This line is a vertical line when the container sits normally on its bottom on a flat surface. Lateral (and laterally), as used to describe and claim this invention, means along the width of the container; that is, along a line extending from one point of the cap, or ring, or container, to a diametrically opposed point on the cap, ring, or container respectively. These lines are horizontal when the container sits normally. Vertical is sometimes used in place of longitudinal, and horizontal is sometimes used in place of lateral. The term "container" includes glass bottles, paper containers, molded plastic containers (e.g., thermoplastic, laminated plastic containers), metal collapsible tubes, thermal setting plastic containers, metal containers and similar containers having a neck and rim defining an open mouth.

Referring primarily to FIGS. 1, 2, 3, 12, 13, 15, 24, 25, 26 and 27, the cap 12 has a top 13 overlying the rim 10 of the container 7 and a depending annular flange (depending flange) 15 which projects downwardly from the top and surrounds an upper portion of the neck 9. An outwardly projecting radial flange 16 is the portion of the top of the cap which extends beyond the depending annular flange 15. Near the lower end of the depending flange 15 is an inwardly directed circumferential bead 17 which engages a peripheral lip 18 surrounding the rim 10 when the cap is secured to the container. The peripheral lip 18 projects outwardly around the rim of the container and together with the inwardly directed circumferential bead 17 of the depending flange 15, forms an interfitting means between the cap and container. The cap 12 is attached to the container 7 by pressing the cap downwardly over the rim 10 which causes the depending flange 15 to flex outwardly to allow the inwardly directed circumferential bead 17 to slip over the peripheral lip 18 of the container and to flex inwardly back towards its original position, where it engages a peripheral lip 18. In this position, the inwardly directed circumferential bead 17 is juxtaposed below the peripheral lip 18. The cap 12 when attached to container 7 presses against the extension 11 of the rim 10, thereby providing a seal. The depending flange 15 is preferably made of flexible material.

Figure 3:
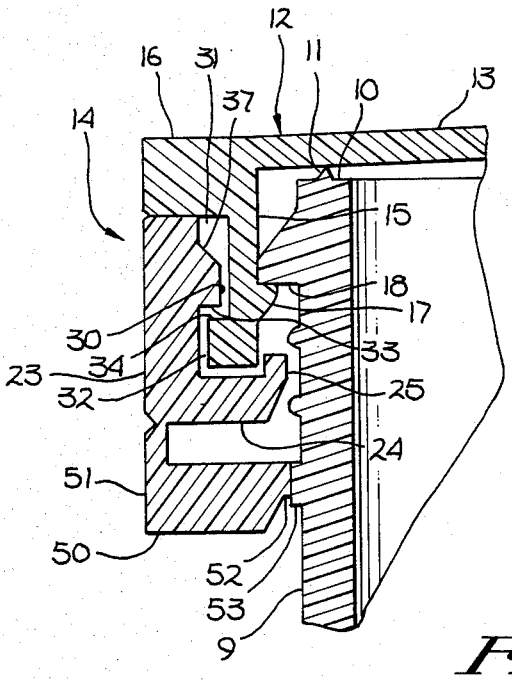
FIG. 3 is a vertical cross-sectional view of the closure shown in FIG. 2.
Figure 4:
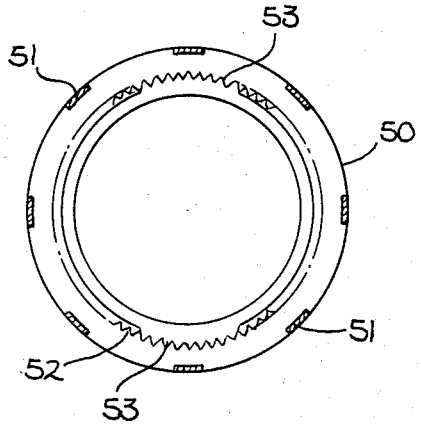
FIG. 4 is a horizontal cross-sectional view of the closure shown in FIG. 2, taken at the line 4—4 as shown.

The safety ring 14 normally surrounds the depending annular flange 15 to block outward flexing of the depending flange, thereby preventing the inwardly directed circumferential bead 17 from slipping over the peripheral lip 18 when one attempts to lift the cap 12. Vertical serrations completely around the safety ring 14 may be added to make it easier to grip the ring. The safety ring 14 generally has a L-shaped vertical cross section, as shown in FIG. 3. The tab 19 of the safety ring, forms an outwardly projecting lateral wall of the safety ring. The generally L-shaped vertical cross section of the safety ring is formed by an annular sidewall 23 and an inwardly projecting bottom wall 24 which extends almost to the neck 9 of the container 7. The inwardly projecting bottom wall 24 normally does not touch the neck 9 of the container 7. The sidewall 23 encircles the depending flange 15 of the cap when the closure is locked, and the bottom wall 24 strengthens the sidewall and assists in positioning the safety ring of the container. The bottom wall 24 also prevents the safety ring from sliding off the neck of the container by engaging the peripheral lip 18 when the safety ring slides down the neck, as it does when the container is tilted to remove the containers contents. As shown in FIGS. 3, 7, 15, 18 and 25, an upwardly projecting flange 25 may be provided on the inner end of the bottom wall to help keep the safety ring around the neck of the container.

Figure 2:
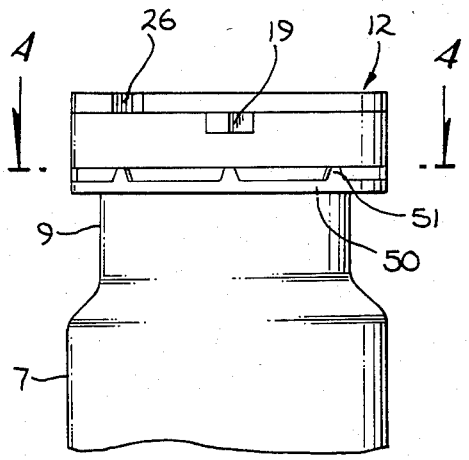
FIG. 2 is a side view of the closure (assembled) shown in FIG. 1.

To remove the cap 12 from the container 7, the safety ring must be precisely alinged in a preselected position relative to the cap 12. The tab 19 of the safety ring and the finger 26 of the cap may be used to indicate when the safety ring is precisely aligned in the preselected angular position ("one angular position") relative to the cap. For example, when the finger 26 overlaps the tab 19, as shown in the embodiment depicted in FIG. 24, the safety ring 14 is precisely aligned with the cap 12 so that the safety ring can be pushed downwardly away from the cap. The safety ring can be pushed downwardly away from the cap only when the safety ring is precisely aligned in the one angular position with the cap. Thus the safety ring of the container as shown in FIGS. 2 and 3, being out of alignment with the cap 12 can not be pushed downwardly away from the cap. Hence this container is "locked"; that is, the safety ring is locked around the cap and the cap can not be removed from the container. Furthermore, the safety ring can not be removed from the cap.

Once the safety ring is moved from its position around the depending flange 15 by slipping the safety ring downwardly off the cap onto the neck 9 of the container, the cap 12 can be lifted off the container 7 since the depending flange 15 is now free to flex outwardly. As one pulls the cap up, the outward flexion of the depending flange 15 permits the inwardly directed circumferential bead 17 to slip around the peripheral lip 18. When the container 7 is to be closed, the cap 12 is pressed back onto the neck 9, so that the inwardly directed circumferential bead 17 slips around and under the peripheral lip 18. Then, the safety ring is raised back into the locked position so that the annular sidewall 23 encircles depending flange 15 of the cap 12. The safety ring can be raised back into the locked position in any annular position with the cap; no alignment of cap and safety ring is necessary to place the safety ring back onto the cap because the fingers which are described below and which hold the ring around the cap, are flexible. It is preferable that the safety ring be flexible also.

Figure 15:
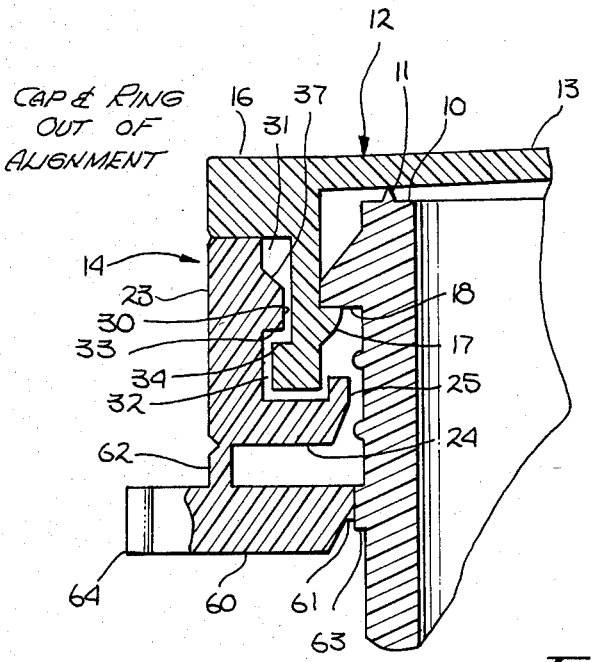
FIG. 15 shows a vertical cross sectional view of the closure in FIG. 13.
Figure 14:
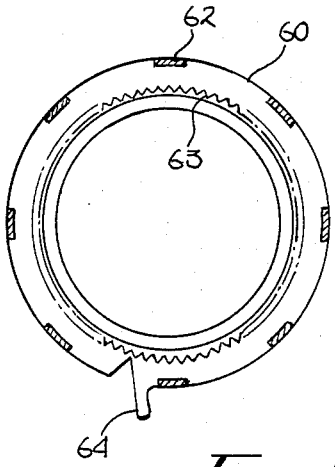
FIG. 14 shows a horizontal cross-sectional view of the closure in FIG. 13, taken at the line 14—14 as shown.
Figure 16:
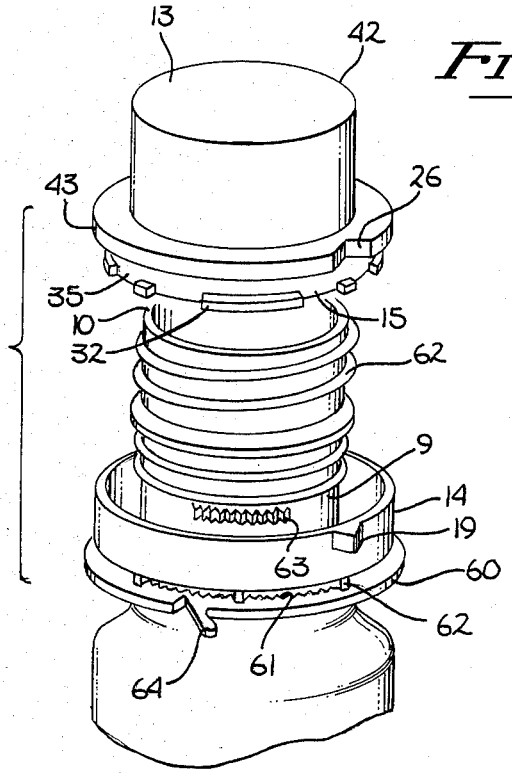
FIG. 16 shows an exploded view of a safety closure having a locking member, the tear strip 60, and a screw cap 42.
Figure 17:
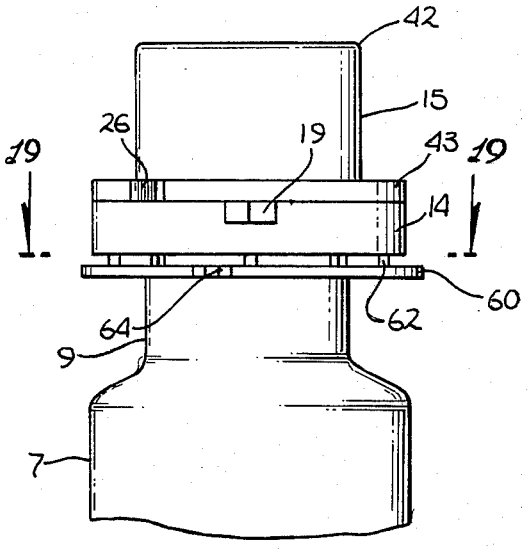
FIG. 17 is a side view of the closure (assembled) in FIG. 16.
Figure 18:
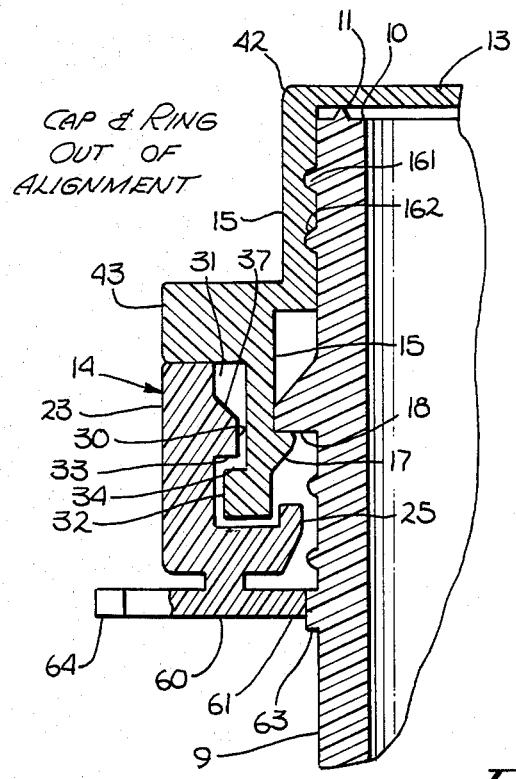
FIG. 18 is a vertical cross-sectional view of the closure shown in FIG. 17.
Figure 19:
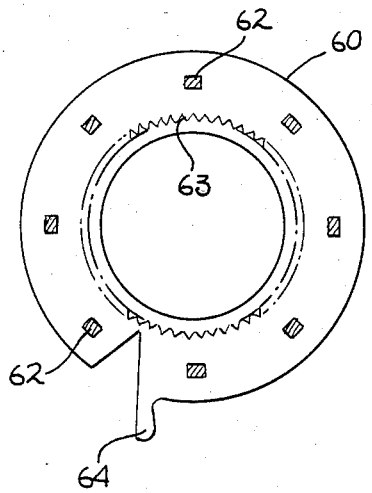
FIG. 19 is a horizontal cross-sectional view of the closure in FIG. 17 taken as shown.
Figure 26:
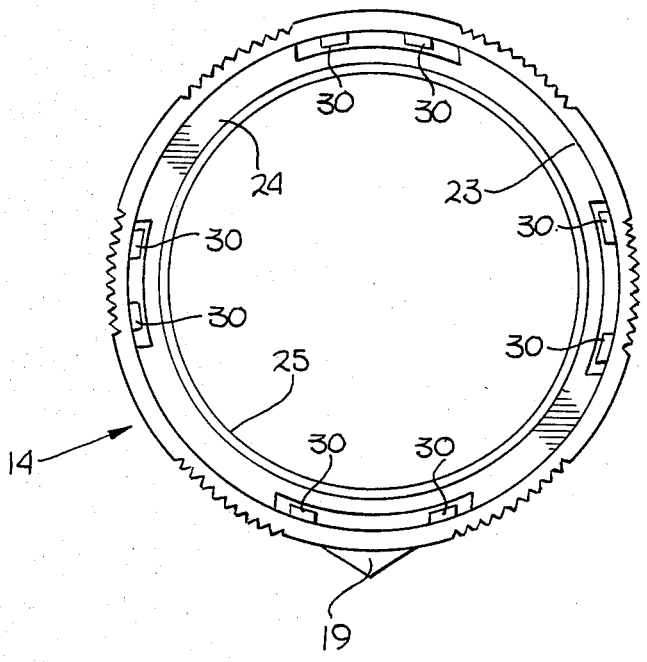
FIG. 26 is a top, enlarged view of the rotary safety ring 14.

As shown in FIGS. 3, 15, 17 (for the screw cap version), and 25, the safety ring locks around the depending flange by at least one, and preferably several, resiliently flexible fingers 30 which may be angularly spaced about the inside of the annular sidewall 23. The safety ring as shown in FIG. 26, has eight such fingers. The number of fingers could vary depending upon the size of the closure and the safety ring. The angularly spaced, flexible fingers 30, connected at one end of the inside of the annular sidewall 23 of the safety ring 14, project inwardly into a circumferential locking groove 31 formed around the depending flange 15 of the cap 12 to lock the safety ring in position around the cap. The locking groove 31 is defined by a first outwardly directed circumferential bead 32 located near the bottom of the depending flange 15, the outwardly projecting radial flange 16 of the top 13 and a longitudinal portion of the depending flange 15. On the screw cap version of these closures, the locking groove is formed by a longitudinal portion of the depending flange 15, the first outwardly directed circumferential bead 32 and the second outwardly directed circumferential bead 43. (see FIG. 18)

As shown in FIGS. 3, 15, 17 (for the screw cap version) and 25, the fingers 30 project inwardly into the locking groove 31 when the safety ring 14 is in place around the depending flange 15; the fingers 30 have free inner ends 33 which overlie an upwardly facing shoulder 34 which forms the bottom wall of the locking groove 31. The fingers 30 closely approach the outer longitudinal portion of the depending flange 15. The upwardly facing shoulder 34 defines the top of the first outwardly directed circumferential bead 32 thus, if a downward force is applied to the ring 14 when the fingers 30 overlie the upwardly facing shoulder 34 (and thus overlie the first outwardly directed circumferential bead 32), the resulting downward motion of the fingers 30 relative to the shoulder 34 wedges the free ends 33 of the fingers 30 downwardly into the shoulder. This longitudinal wedging of the fingers 30 against the shoulder 34 prevents further downward movement of the safety ring since such movement can occur if the fingers buckle longitudinally, which requires an extremely large force. Such a force would generally deform the safety ring so much that it would break. Accordingly, the fingers 30 and the locking groove 31 hold the safety ring in place around the cap by keeping the safety ring positioned around the depending annular flange 15. Thus, the safety ring is locked around the cap. Furthermore, if the safety ring is not aligned in the preselected annular position in which the safety ring may be removed from the cap, the cap can not be removed from the container.

Figure 7:
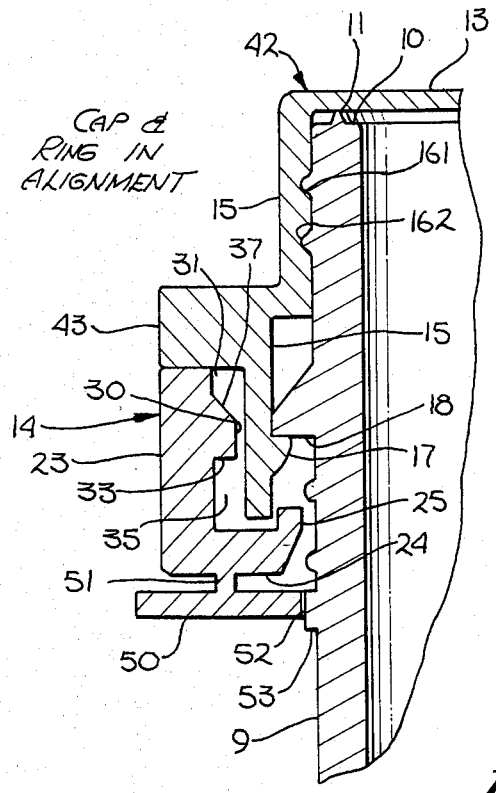
FIG. 7 is a vertical cross-sectional view of the closure (assembled) shown in FIG. 5, with safety ring aligned with the screw cap.
Figure 8:
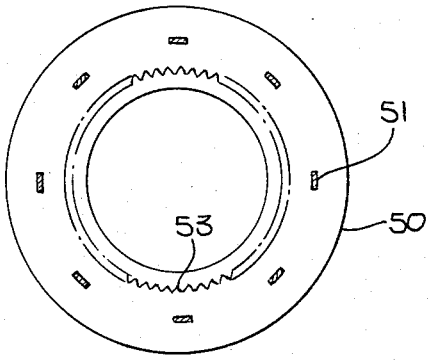
FIG. 8 is a horizontal cross-sectional view of the closure shown in FIG. 6, taken at the line 8—8 as shown.
Figure 27:
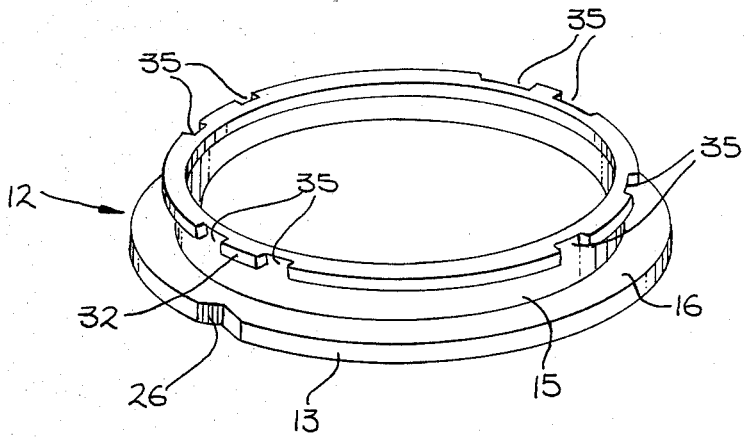
FIG. 27 shows the snap cap in a view from the underside of the snap cap.

To allow the fingers 30 to move out of the locking groove 31 when the safety ring 14 is to be unlocked (for the removal of the cap 12), a number of longitudinally extending release grooves 35, as shown in FIGS. 7, 1 and 27, are formed in the outer side of the depending flange 15 between the locking groove 31 and the lower end of the flange 15. The number of release grooves should be equal to the number of fingers 30 on the safety ring. Thus, the depending flange 15 of FIG. 27, designed to work with the safety ring 14 depicted in FIG. 26, has eight release grooves. The number of release grooves could vary depending upon the size of the closure. The release grooves 35 extend from the locking groove 31 through the upwardly facing shoulder 34 to the lower longitudinal end of the depending flange 15. The fingers 30 and their release grooves 35 are formed in a special manner (by sizing and spacing them to match each other) to prevent downward movement of the safety ring except in one angular position of the safety ring with regard to the cap, thus limiting the release of the cap to that one position. Preferably, fingers 30 and the associated release grooves 35 are of different sizes so that the safety ring 14 is releaseable in only one angular position. Each of the release grooves 35 is to be aligned with a particular matching finger, which alignment occurs in one pre-selected angular position when the longitudinally extending release grooves 35 will permit the fingers 30 to slide through and thereby release the safety ring from the cap. As used to describe and claim this invention, alignment means that the safety ring is angularly placed relative to the cap so that it may be released by sliding the fingers 30 through the longitudinally extending release grooves 35. Thus, when the safety ring is out of alignment with the cap, the safety ring can not be removed from the cap by pushing it downwardly away from the cap. The word "locked" as used to describe and claim this invention, means that the safety ring is positioned around the cap, whether or not the safety ring is aligned with the cap, so that the annular sidewall 23 surrounds the depending annular flange 15 and the fingers 30 are located in the locking groove 31. Thus, the closure is unlocked whenever the safety ring has been moved downwardly away from the cap so that the annular sidewall no longer surrounds the depending annular flange 15, and the fingers 30 are no longer located in the locking groove. Each of the release grooves 35 is slightly larger than its associated finger 30 and, when properly aligned with the finger, will permit it to slide from the locking groove 31 to the release groove 35 in the first outwardly directed circumferential bead 32 and off the cap 12.

Once the safety ring 14 has been slipped off the cap (i.e., the safety ring is no longer locked around the cap), the cap can be pulled or snapped off the container 7 to allow dispensing of its contents. In the screw cap versions of these closures, once the safety ring 14 has been slipped off the screw cap, the cap can then be unscrewed off the container. To replace the cap 12 and lock it in a position on the container 7, the cap is snapped over the rim 10 and safety ring is pushed upwardly into position around the depending flange 15. Since the fingers 30 are flexible and incline inwardly, and have an upper edge 37 which is inclined downwardly, no prealignment of the fingers in the release grooves 35 is necessary. When the safety ring 14 is moved upwardly with the fingers 30 out of alignment with the release grooves 35, the first outwardly directed circumferential bead 32 of the depending flange 15 flexes the fingers 30 and the annular sidewall 33 of the safety ring outwardly. The outward deflection occurs as the upper edge 37 of the finger slides over the first outwardly directed circumferential bead 32. Then, as the safety ring 14 reaches the fully seated position in which the top of the annular sidewall 23 approaches the underside of the top 13 of the cap 12, the fingers are aligned in the locking groove, thereby locking the safety ring 14 to the cap. Thus, the safety ring can be returned into locking position around the cap without aligning it with the cap. It should be noted that the ring and cap form an assembly when the ring is locked around the cap.

The fingers 30, as illustrated in FIGS. 3 and 26, have generally rectangular cross sections and are integrally joined to the safety ring 14. In addition, the plurality of recesses may be formed in the annular sidewall, such recesses being aligned with the fingers to receive them substantially flush with the annular sidewall as the safety ring is moved back upwardly onto the cap (i.e., locking the safety ring onto the cap). Alternatively, the fingers may be formed as cut outs from the annular sidewall 23 of the safety ring 14, such cut outs being integrally joined to the safety ring at their upper ends, and plurality of recesses being formed from the spaces from which the fingers were cut.

As illustrated in FIGS. 1, 5, 12, and 16, this invention provides a locking member (e.g., the second ring 50; a tear strip 60) located below the rotary safety ring and having a first engaging means. The first engaging means (e.g., inwardly directed teeth 52 and 61) engages a second engaging means (e.g., outwardly directed teeth 53 and 63) located on the neck of the container so that the locking member cannot be rotated relative to the container. A connection (e.g., peel pins 62 or fragile tear pins 51) is provided between the locking member and the rotary safety ring thereby preventing the safety ring from rotating. Thus, when the rotary safety ring is locked and out of alignment with the cap, whether that cap is the snap on cap or the screw cap, the closure cannot be opened without breaking the connection. The connection is usually a fragile, easily breakable plastic or aluminum member which is rigid enough to prevent the rotary safety ring from rotating as well as to prevent the locking member from being rotated relative to the container. Since the rotary safety ring may have to be rotated into alignment in order to open the closure (if the closure is manufactured out of alignment), the connection and the locking member prevents the rotary safety ring from being rotated, and thereby prevents the closure from being opened. Thus, the connection makes the closure both tamper evident and tamper resistant, because tampering will be evidenced by the missing connection (as well as by the displaced locking member) and the connection also provides resistance on first opening the container. If the consumer is instructed that the container has been tampered with or opened if the connection is broken or the locking member is displaced, then the locking member and connection become a way to prevent tampering with the contents of the container 7. Typically, the locking member is a ring or a portion of a ring which encircles the neck below the rotary safety ring. The first engaging means on the locking member is typically inwardly directed teeth on the inside edge of the locking member. Similarly, the second engaging means, located on the neck, is a plurality of outwardly directed teeth located on the neck, which teeth, are designed to engage and mesh with the teeth located on the locking member. These teeth, of course, resemble the teeth of a gear. Two basic types of connections are described below. The first type, a fragile tear pin, connects the locking member to the rotary safety ring and resists rotation of the rotary safety ring (since the locking member itself cannot be rotated relative to the container). However, the fragile tear pin will not prevent rotation of the rotary safety ring since it is fragile; when a sufficient rotary force is applied to the rotary safety ring, the fragile tear pin will tear as the rotary safety ring is rotated relative to the locking member. The other basic kind of connection, the peel pin, also connects the locking member (usually a tear strip when a peel pin is utilized) to the rotary safety ring. The peel pin, however, is resistant to breaking when the rotary safety ring is rotated relative to the locking member; the peel pin is constructed so that a typical rotary force applied to the rotary safety ring will not break the peel pins. The peel pins are constructed to allow the locking member to be peeled from the rotary safety ring. Usually, the portion of the peel pin closest to the rotary safety ring is the smallest part of the peel pin and is the part that gives way when the locking member is peeled from the rotary safety ring.

Referring now to FIGS. 1, 2, 3 and 4, a safety closure 5 on a container 7 having a rim defining a mouth and a neck located below that rim, will be described. The container 7 includes a peripheral lip 18 around the rim of the container. The safety closure includes the snap cap 12 which has a top 13 overlying the mouth and the rim and has a depending annular flange 15 which engages, via the inwardly directed circumferential bead 17, the peripheral lip 18. The rotary safety ring 14 locks the snap cap onto the container whenever the rotary safety ring is in a locked position. The function and structure of the cap 12, the rotary safety ring 14, the fingers 30 and the release gears 35 has been described above. Turning to FIG. 1, a second ring 50 is shown encircling the neck 9 below the rotary safety ring. The second ring 50 includes a first engaging means which engages a second engaging means located on the neck. As shown in FIG. 1, the first engaging means may be a plurality of inwardly directed teeth 52 located on the inside edge of the second ring 50. The second engaging means may be a plurality of outwardly directed teeth 53 located on the neck and designed to mesh with the first engaging means, in this case, the plurality of inwardly directed teeth 52. Other engaging means may be used in accordance with the present invention. For example, a tooth on the second ring projecting into a notch in the neck of the container may fix the second ring 50 so that it cannot rotate relative to the container. The tooth of the second ring would be the first engaging means, and the notch in the neck of the container would be the second engaging means. Generally, the first engaging means of the second ring would be located on the inside edge of the second ring 50. The plurality of outwardly directed teeth 53 located on the neck engage the plurality of inwardly directed teeth 52 (located on the inside edge of the second ring); this engagement prevents the second ring from being rotated relative to the container. Since the second ring is connected to the rotary safety ring by the fragile tear pin 51, shown as a plurality of angularly spaced fragile tear pins in FIG. 1, the rotary safety ring cannot be rotated until the fragile tear pins connecting the rotary safety ring to the second ring are broken. Thus, if the rotary safety ring is locked and out of alignment with the snap cap, then the closure cannot be opened without tearing (or breaking) the fragile tear pin 51. The fragile tear pin 51 is constructed so that it will tear when a sufficient rotary force is applied to the safety ring. Thus, by rotating the safety ring with a sufficiently large force, one may break all of the fragile tear pins connected to the rotary safety ring, and the second ring 50 will be displaced down to the bottom of the neck and the rotary safety ring will be free to be rotated into alignment with the cap. Thus, this closure is both tamper evident and tamper resistant because the broken fragile tear pin will indicate that the closure has been tampered with (i.e., someone has tried to open the closure). Furthermore, if all of the plurality of angularly spaced fragile tear pins 51 are broken, the second ring 50 will fall from its place just below the rotary safety ring to the bottom of the neck; thus, the displaced second ring will also indicate that the closure has been tampered with. Also, since the second ring provides resistance to the first opening of the closure, the consumer will know immediately whether the closure has been tampered with when the consumer finds that the rotary safety ring may be rotated without any resistance from the second ring 50.

While the instant embodiment has been shown and described with the second ring which encircles the neck, the present invention will work when only a portion of the second ring encircles a portion of the neck. For example, instead of a second ring which encircles all 360 degrees of the neck 7, a portion of the second ring encircling only half of the neck (i.e., 180 degrees) will also work with the present invention. It is preferable that the portion of a second ring (i.e., a semi-circle or something less than a full circle) encircle a substantial portion of the neck and be attached by several fragile tear pins to the rotary safety ring 14. Usually, the fragile tear pin will be angularly spaced about the neck of the container.

Figure 5:
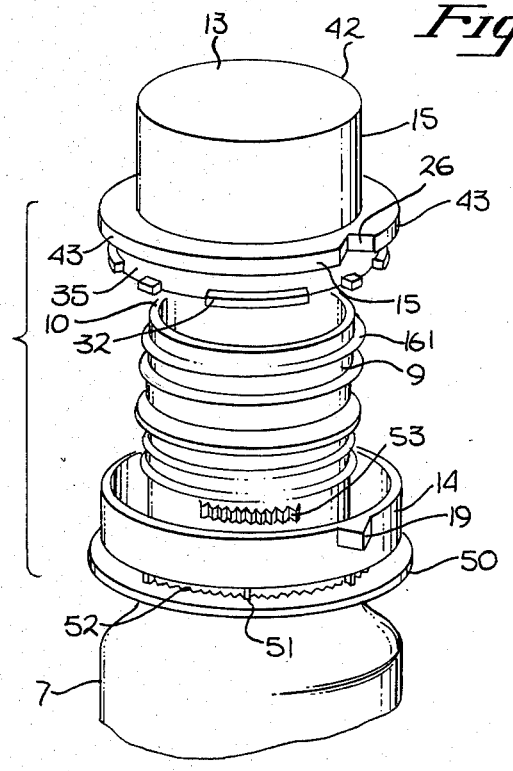
FIG. 5 is an exploded view of a safety closure having a locking member, the second ring 50, and a screw cap 42.
Figure 6:
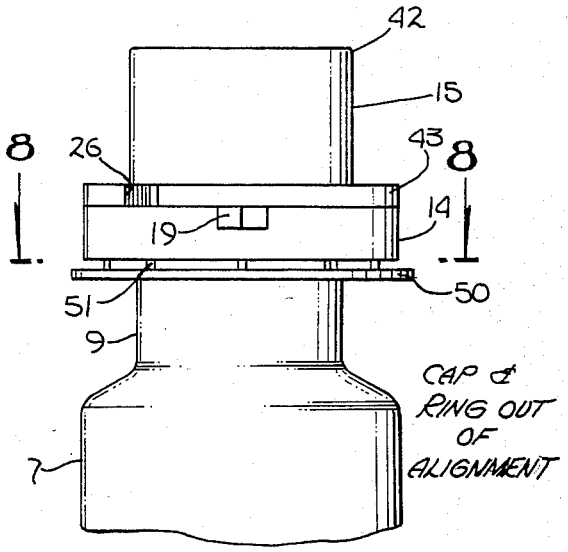
FIG. 6 is a side view of the closure (assembled) shown in FIG. 5.

The second ring 50, and its associated components (i.e., the plurality of angularly spaced fragile tear pins and the first and second engaging means) may also be provided on a closure, similar to the one described above, but having a screw cap rather than a snap cap. Referring to FIGS. 5, 6, 7 and 8, a safety closure of the general type described above is illustrated, wherein the safety closure includes a screw cap rather than a snap cap. The screw cap 42 has a top 13 overlying the mouth and the rim 10 and has a depending annular flange 15 projecting below the top 13. The container 7 includes a screw means 161 for engaging the screw cap 42. As is well known in the art, there are various ways to provide screw means for engaging the screw cap as well as corresponding screw means 162 on the screw cap for engaging the container. For example, a helical thread (i.e., protrusion) on the neck would constitute a screw means for engaging the screw cap and the corresponding means for engaging the container would be a helical groove on the inner wall of the depending flange of the screw cap (or even another helical thread on the cap) matching the screw means on the neck. As shown in FIGS. 5 and 7, the helical thread 161 on the neck 9 will mesh with the corresponding screw means 162 on the screw cap 42, which corresponding screw means is a helical groove which matches the helical thread of the neck 9. Usually, the depending annular flange of the screw cap 42 will have the corresponding screw means for engaging the container 7.

The screw cap 42 includes an inwardly directed circumferential bead 17 which engages the peripheral lip 18 of the container 7 when the screw cap 42 is screwed onto the container 7. Preferably, the screw means for engaging the screw cap 42 is located on the neck between the rim 10 and the peripheral lip 18 of the container 7. Thus, the corresponding screw means 162 of the depending annular flange of the screw cap 42, is usually located between the top 13 and the inwardly directed circumferential bead 17. The screw cap 42 also has a first outwardly directed circumferential bead located below the top 13, which first outwardly directed circumferential bead cooperates with a second outwardly directed circumferential bead 43 to define a circumferential locking groove extending around the outer side of said flange.

Thus, the screw cap 42 is substantially similar to the snap cap 12 except that the screw cap 42 has a corresponding screw means for engaging the container 7, whereas the snap cap 12 has no corresponding screw means. Furthermore, the screw cap 42 has a second outwardly directed circumferential bead 43 for forming the upper end of the locking groove, whereas, snap cap 12 has no second outwardly directed circumferential bead (as the cap 12 uses the outwardly projecting radial flange 16 of the top 13 for providing such upper end). The rotary safety ring 14 is modified to work with the screw cap 42, but in all respects has all the components described above, including an annular sidewall surrounding the depending flange 15 and overlying the locking groove 31 and has fingers 30 which project into the locking groove 31, such fingers being attached to the inside wall of the annular sidewall 23. Furthermore, the fingers 30 pass through longitudinally extending release grooves 35 located in the screw cap 42 as the fingers 30 do for the snap cap 12. In all other respects, the safety closure having the screw cap 42 is identical to the safety closure for the snap cap 12 described above.

As shown in FIGS. 5, 6, 7 and 8, the second ring 50 (or a portion of the second ring 50) may be provided on a safety closure having a screw cap 42. The safety ring 50 encircles the neck below the rotary safety ring and has a first engaging means, usually a plurality of inwardly directed teeth 52 located on the inside edge of said second ring. The first engaging means of the second ring 50 engage a second engaging means located on the neck, which second engaging means is usually a plurality of outwardly directed teeth 53 located on the neck. The second ring 50 is connected to the rotary safety ring by a fragile tear pin 51, and preferably several angularly spaced fragile tear pins, which tear pins tear when the rotary safety ring is rotated relative to the second ring. Thus, the safety closure with the screw cap 42 is both tamper resistant and tamper evident. When the rotary safety ring is locked and out of alignment with the screw cap, the closure cannot be opened without tearing the fragile tear pins. When one uses the present invention with only a portion of the second ring 50, the fragile tear pins should be made so that they break when they are bent. This will prevent someone from attempting to lift the second ring 50 off from the second engaging means on the neck so that the rotary safety ring may be rotated thereby allowing the closure to be opened. If the fragile tear pins break when they are bent, it will be impossible to lift the portion of a second ring off the second engaging means to free the rotary safety ring.

Turning now to the embodiment of the present invention illustrated in FIGS. 12, 13, 14 and 15, a tear strip 60 is shown as the locking member of the safety closure 5. The safety closure 5 has been described above. As noted above, it includes the cap 12, (or the screw cap 42) the rotary safety ring 14, the fingers 30 and the longitudinally extending release grooves 35, all described above.

In accordance with the present invention, a tear strip 60 is provided with the safety closure 5, thereby making that closure both tamper resistant and tamper evident as described below. The tear strip 60 encircles the neck of the container 7 below the rotary safety ring and has a first engaging means, which is usually a plurality of inwardly directed teeth 61 located on the inside edge of said tear strip. As noted previously, other first engaging means may be utilized in accordance with the present invention. For example, a tooth on the tear strip 60 may be used as the first engaging means, which means engage a second engaging means located on the neck. The second engaging means in this circumstance may be a notch designed to accept the tooth of the tear strip 60. The first engaging means of the tear strip 60 engages the second engaging means, which is usually a plurality of outwardly directed teeth located on the neck 9. The plurality of outwardly directed teeth 63 engage the plurality of inwardly directed teeth 61 located on the inside edge of the tear strip. The two sets of teeth mesh and thereby prevent the tear strip 60 from being rotated relative to the container. The tear strip is connected to the rotary safety ring 14 by at least one peel pin 62. Preferably, the tear strip 60 is connected to the rotary safety ring 14 by a plurality of angularly spaced peel pins 62. The peel pin 62 is resistant to breaking when the rotary safety ring is rotated relative to the tear strip 60, but will allow the tear strip to be peeled from the rotary safety ring 14. Thus, the peel pin may be constructed so that the tip of the pin attached to the rotary safety ring 14 is too thick to be sheared off by a rotary force but thin enough that the tear strip and its attached pins may be peeled from the rotary safety ring 14. Since the peel pin 62 connects the tear strip 60 to the rotary safety ring 14, and since the tear strip 60 cannot be rotated relative to the container (because the first engaging means engages the second engaging means), the tear strip 60 prevents the rotation of the rotary safety ring. Thus, if the container is manufactured with the tear strip 60 in place when the rotary safety ring is out of alignment, then the closure cannot be open without peeling the tear strip from the rotary safety ring. Thus, the tear strip 60 and the peel pin 62 make the safety closure tamper resistant and tamper evident in the same way that the second ring 50 and the fragile tear pin 51 makes the associated safety closure tamper resistant and tamper evident. Thus, a missing peel pin or a displaced tear strip will indicate that the closure has been tampered with; furthermore, since the tear strip provides considerable resistance to the first opening of the closure, the consumer will immediately realize upon opening the closure whether or not the closure has been tampered with. That is, if no resistance is provided to the first opening by the consumer, the consumer will know that the closure has been tampered with. To facilitate the peeling off of the tear strip 60, a peel tab 64 attached to the tear strip may be provided as part of the safety closure. This peel tab 64 would allow the tear strip to be peeled from the rotary safety ring.

It will be observed that the peel pin 62 may be constructed so that its breaking point is anywhere along the length of the peel pin. Similarly, the fragile tear pin may be constructed in the same way.

Instead of using a full circular tear strip 60 which completely surrounds the neck 9 of the container 7, the present invention may properly function with only a portion of the tear strip 60 encircling a portion of the neck 9. Thus, rather than a full circular tear strip 60, one may use a tear strip which is a half circle or any other possible part of the tear strip 60.

As shown in FIGS. 16, 17, 18 and 19, the tear strip 60, and its associated components (peel pin, first engaging means, and second engaging means) may be used on a safety closure having a screw cap 42 rather than the snap cap 12. This has been described previously. Thus, the safety closure with the screw cap 42 may have the rotary safety ring 14, which is associated with the screw cap 42 attached by the peel pin 62 to the tear strip 60 which, by its first engaging means engages a second engaging means located on the neck 9. Thus, the screw cap 42 cannot be removed until the tear strip has been peeled, preferably by the peel tab 64 attached to the tear strip, from the rotary safety ring 14.

Figure 9:
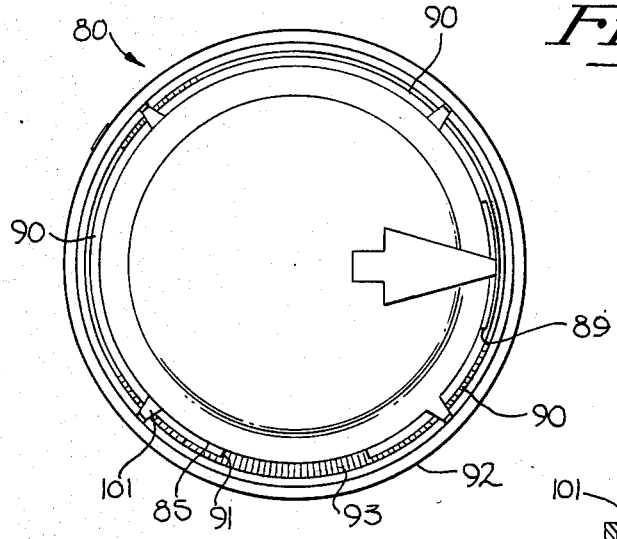
FIG. 9 shows a top view of the safety closure 80.
Figure 10:
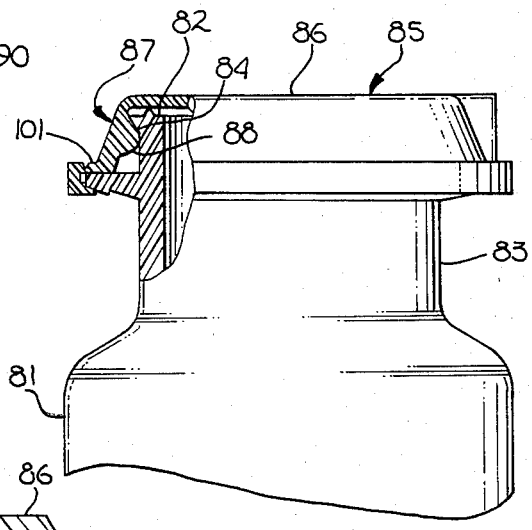
FIG. 10 shows a side view of the closure 80.
Figure 11:
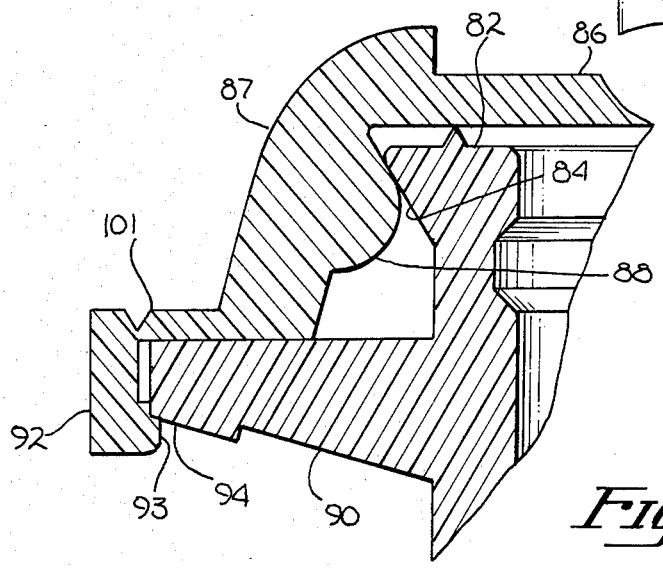
FIG. 11 shows a vertical cross-sectional view of the safety closure 80.
Figure 12:
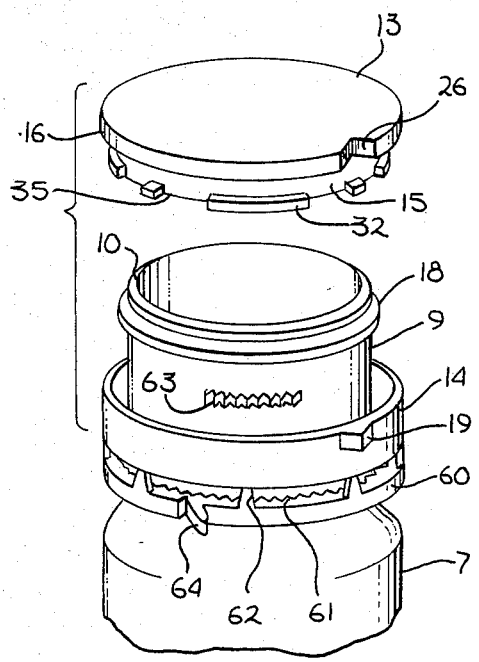
FIG. 12 illustrates an exploded view of a safety closure having a locking member, the tear strip 60.
Figure 13:
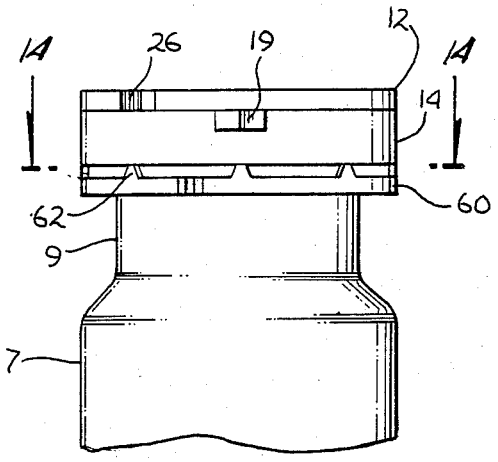
FIG. 13 is a side view of the closure shown in FIG. 12.

Turning now to the safety closure 80 illustrated in FIGS. 9, 10 and 11, a child resistant safety closure which is also tamper resistant and tamper evident is described. The safety closure 80 is for a container 81 having a rim 82 defining a mouth and having a neck 83 located below the rim 82. A peripheral lip 84 is provided around the rim of the container. A snap cap 85 has a top 86 overlying the mouth and rim and has a depending annular flange 87 projecting below the top. The depending annular flange 87 includes an inwardly directed circumferential bead 88 which engages the peripheral lip 84. When the snap cap 85 is snapped on the container 81, the inwardly directed circumferential bead will be engaged below the peripheral lip 84. Thus, an upward force must be applied to the cap to remove the cap from the container since the peripheral lip will prevent the cap from being pulled off.

An annular ridge 90 is provided on the neck of the container below the bottom edge of the depending annular flange when the cap is secure onto a container (when the inwardly directed circumferential bead 88 of the snap cap 85 is engaged below the peripheral lip 84 of the container). An outwardly directed thumb tab 89 is provided on the snap cap 85 and is located at the bottom edge of the depending annular flange 87. The outwardly directed thumb tab 89 provides a means for easily applying an upward force on the cap in order to lift the cap off the container (in order to open the closure). The outwardly directed thumb tab 89 extends around only a portion of the depending annular flange and does not extend out beyond the annular ridge 90. That is, the annular ridge 90 extends outwardly from the neck at least as far as the outwardly directed thumb tab 89. Thus the annular ridge completely blocks the underside of the snap cap 85 and prevents one from getting one's fingers underneath the cap in order to lift the cap off. However, an indented portion 91 is also provided on the annular ridge, which indented portion 91 allows the outwardly directed thumb tab 89 to extend outwardly beyond the indented portion of the annular ridge when that thumb tab is positioned over the indented portion. Thus, when the thumb tab is positioned over the indented portion, the underside of the outwardly directed thumb tab 89 is exposed so that one may apply one's fingers to the cap and thereby remove the cap. It is important to realize that the outwardly directed thumb tab is exposed only when the thumb tab is positioned over the indented portion. Hence, the annular ridge prevents the removal of the snap cap from the container unless the thumb tab is positioned over the indented portion.

It should be noted, that it is preferable that the depending annular flange 87 projects down so far that it very closely abuts the annular ridge 90. Thus, the depending annular flange 87, having its bottom edge closely abutting the annular ridge 90, will prevent one from attempting to lift off the snap cap by inserting one's fingernails or a similar sharp device into the space between the depending annular flange 87 and the annular ridge 90.

This closure is child resistant because the person attempting to open the closure must be able to read the instructions on the cap and realize that the outwardly directed thumb tab 89 must be positioned over the indented portion 91 in order to allow one to easily remove the cap. An arrow may be provided on the cap to show where the outwardly directed thumb tab is.

In accordance with the present invention, a snap off ring 92 is provided around the neck 83 of the container 81. The snap off ring includes a first engaging means 93, which is usually a plurality of upwardly extending teeth located on the inside edge of the snap off ring 92. The snap off ring 92 encircles the neck of the container 81, and usually encircles the annular ridge 90. A second engaging means 94 is located on the annular ridge and engages the first engaging means so that the snap off ring cannot be rotated relative to the container. The second engaging means 94 is usually a plurality of teeth which extend substantially downwardly from the underside of the annular ridge. The snap off ring 92 is connected to the snap cap 85 (and generally connected to the depending annular flange 87 of the snap cap 85) by at least one breakable arm 101. Thus, since the snap off ring cannot be rotated relative to the container (because of the first engaging means engaging the second engaging means), and since the snap off ring 92 is connected to the snap cap 85 by the breakable arm 101, the snap cap will not be easy to rotate. That is, the breakable arm connecting the snap off ring to the snap cap resists rotation of the snap cap. Since the breakable arm 101 is breakable, and it is usually designed to break when the snap cap is rotated, then, the snap cap cannot be rotated without breaking the breakable arm. Furthermore, if in the assembling process, the snap cap is placed on the container so that it is out of alignment with the indented portion 91 (i.e., the outwardly directed thumb tab has no portion thereof positioned over the indented portion 91), then the snap cap cannot be removed without breaking the breakable arm. Since it is possible to construct the snap off ring so that it extends under the annular ridge it will be impossible to open the closure without breaking the arm 101 even if the thumb tab is aligned over the indented portion.

It is preferable that the snap off ring be connected to the snap cap by a plurality of breakable arms 101 and that the snap off ring form an entire circle around the annular ridge 90. Moreover, it is preferable that the snap off ring extend under the annular ridge because the snap off ring will thereby prevent one attempting to tamper with the container from successfully tampering with it by pulling the whole assembly (i.e., cap and snap off ring) off the container by inserting a sharp object between the annular ridge 90 and the depending annular flange 87. It is noted also in this regard that the first engaging means is a plurality of upwardly extending teeth located on the inside edge of the snap off ring; these teeth engage the second engaging means, which preferably are teeth extending substantially downwardly from the underside of the annular ridge. Thus, the engaging means reinforce against the possibility of tampering by lifting the whole assembly off the container. Finally, the snap off ring may have a portion thereof extending up beyond the annular ridge 90, which portion would block any opening between the depending annular flange 87 and the annular ridge 90.

The breakable arm 101 is fragile enough that each of the plurality of breakable arms will be broken by rotating the snap cap relative to the snap off ring. Thus, if the closure is assembled with the snap cap out of alignment with the intended portion of the annular ridge 90, then the closure cannot be opened without breaking the breakable arms. Even if the thumb tab of the snap cap is aligned with the indented portion, the arms 101 will break if the closure depicted in FIGS. 9, 10 and 11 is opened. Thus, these closures are both tamper resistant and tamper evident in that the consumer will see that the closure has been tampered with because the breakable arms have been broken. Furthermore, the consumer will notice that the snap cap 85 can be rotated without any resistance from the breakable arm when the closure has been tampered with.

Figure 20:
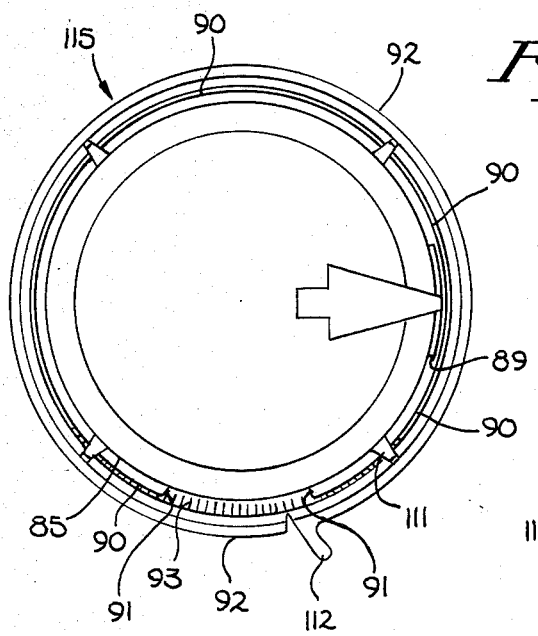
FIG. 20 shows a top view of the safety closure 115.
Figure 21:
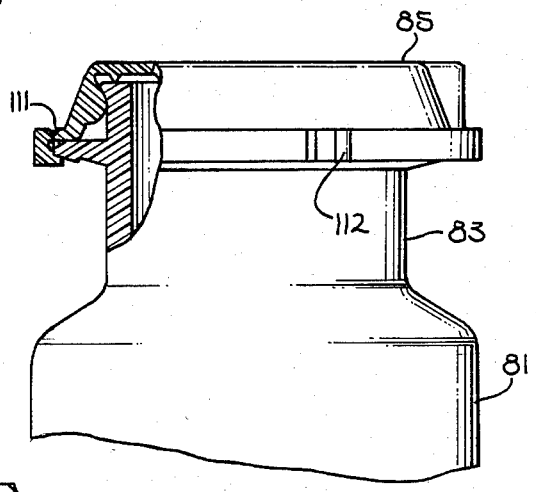
FIG. 21 shows a side view of the safety closure 115.
Figure 22:
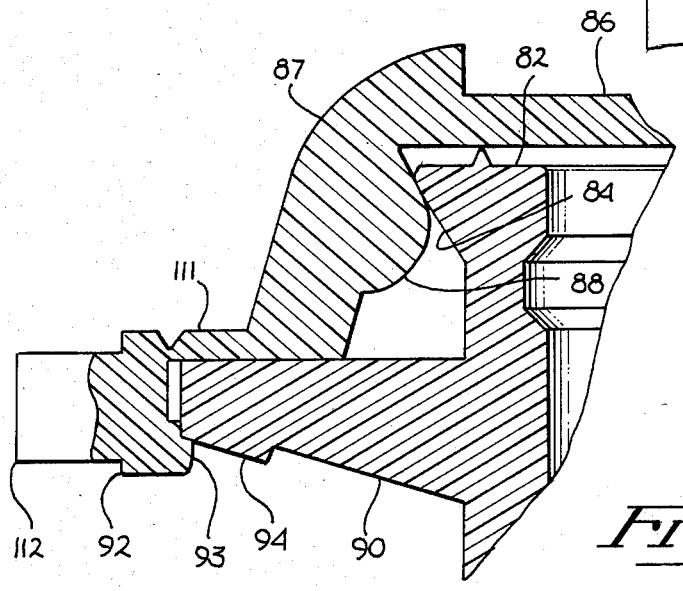
FIG. 22 is a vertical cross-sectional view of the closure 115.

Shown in FIGS. 20, 21 and 22 is a related safety closure 115, very similar to the safety closure 80 described previously. The safety closure 115 has all the elements of the safety closure 80 described previously except that the safety closure 115 does not have the breakable arm 101; rather, it has at least one peg connecting the snap off ring to the snap cap. This peg 111 is resistant to being broken when the snap cap is rotated relative to the container. The peg, however, will allow the snap off ring to be peeled from the snap cap. Since the peg is resistant to breaking when the snap cap is rotated, the peg prevents the rotation of the snap cap unless the snap off ring is peeled from the snap cap. Thus, the snap cap cannot be rotated without removing the snap off ring. Furthermore, when the snap cap is placed out of alignment with the indented portion 91, the snap cap cannot be removed without removing the snap off ring from the snap cap by peeling the snap off ring, preferably using the rip tab 112 provided on the snap off ring. The rip tab 112 is attached to the snap off ring and allows the snap off ring to be peeled from the snap cap. The closure depicted in FIGS. 20, 21 and 22 (having the snap off ring partially under the annular ridge 90) cannot be opened (i.e., the cap removed) without peeling off the snap off ring (or breaking the pegs 111) even if the thumb tab 89 is aligned with the indented portion 91.

With regard to both the safety closure 115 and the safety closure 80, described above, both closures will function in accordance with the invention even if only a portion of the snap off ring 92 is used on the closures. Thus, rather than having a snap off ring which forms a complete circle, thereby encircling the entire neck of the container, a portion of a snap off ring may be used which only encircles a portion of the neck. Thus, a portion of a snap off ring which resembles a semi-circle (i.e., 180 degrees) may be used in place of the whole snap off ring.

The snap off ring 92 of the safety closure 115 is preferably placed so that at least a portion of the snap off ring extends under the annular ridge. Thus, the first engaging means, being a plurality of upwardly extending teeth located on the inside edge of the snap off ring, engage a second engaging means, being a plurality of teeth which extends substantially downwardly from the underside of the annular ridge. The snap off ring having at least a portion thereof under the annular ridge, will prevent one from lifting up the cap while the snap off ring is connected to the cap.

Referring now to FIGS. 23, 24 and 25, a safety closure 135 is illustrated; this closure includes the screw cap 12 (or it may include the screw cap 42), the safety ring 14, a circumferential shoulder 130, a cylindrical sheath 131, at least one peel pin 132, and a peel tab 133. The cap 12 is held on place on the container 7 by a rotary safety ring 14 which must be aligned with the cap 12 in one angular position and pushed downwardly away from the cap before one can remove the cap from the container. The rotary safety ring 14 is locked around a portion of the cap by the fingers 30, which usually extend from the inside of the safety ring, and which fingers 30 fit into a circumferential locking groove 31 formed between the safety ring and the cap. The safety ring 14 is unlocked by aligning it with the cap 12 in one angular position so that the fingers 30 slide through longitudinally extending release grooves 35 in the locking groove, when the safety ring 14 is pulled downwardly away from the cap 12. The present closure 135 also works with the screw cap 42 as described above. The snap cap 12 and the screw cap 42 for the safety closure 135 both have a top 13 overlying the mouth and rim of the container 7 and have a depending annular flange 15 projecting below the top, which depending annular flange 15 has an inwardly directed circumferential bead 17 which engages the peripheral lip 18 of the container 7. The depending annular flange 15 also includes a first outwardly directed circumferential bead 32 located below the top 13. The first outwardly directed circumferential bead 32 cooperates with the top 13 of the snap cap 12 to define a circumferential locking groove 31 extending around the outer side of the depending annular flange 15. On the embodiment of the safety closure 135 that uses a screw cap 42 rather than a snap cap 12, the circumferential locking groove 31 is defined by the first outwardly directed circumferential bead 32 and a second outwardly directed circumferential bead 43 located above the first outwardly directed circumferential bead 32.

The rotary safety ring 14 of the safety closure 135 is identical to the safety ring described above in that it includes an annular sidewall 23 surrounding the depending annular flange 15 and overlies the locking groove 31. The annular sidewall 23 is closely spaced to the locking groove and to the first outwardly directed circumferential bead so that the inwardly directed bead 17 is held in engagement with the lip 18 and thereby prevents removal of the cap. The rotary safety ring 14 of the closure 135, whether that closure uses the snap cap 12 or the screw cap 42, includes a plurality of annularly spaced fingers 30 on the inner side of the annular sidewall 23 projecting into the locking groove 31 and overlying the bottom wall of the locking groove. These fingers 30 prevent downward movement of the safety ring 14 along the cap since the fingers 30 are inclined inwardly and downwardly into the locking groove and have free inner ends positioned to be wedged against the bottom of the locking groove to keep the safety ring from being pulled downwardly relative to the cap, unless the fingers 30 are aligned with their associated release grooves 35. A plurality of longitudinally extending release grooves 35 is provided in the first outwardly directed circumferential bead 17 (whether the snap cap 12 or the screw cap 42 is used with the closure 135). The release grooves 35 are sized and spaced to permit the movement of the fingers 30 through the first outwardly directed circumferential bead 32 in one angular position of the safety ring 14 about the cap; thus, the release grooves allow downward movement of the safety ring away from the cap for the removal of the cap from the container in one angular position.

In addition to the elements described above, the safety closure 135 includes a circumferential shoulder 130 which is attached to the neck below the rotary safety ring and projects outwardly from the neck and surrounds the neck. This circumferential shoulder 130 may be used for glass containers where the shoulder 130 may be fabricated out of the glass so that it is integrally joined to the glass container 7. Of course, the circumferential shoulder 130 may be used on containers constructed out of other materials. A cylinderical sheath 131 is provided between the circumferential shoulder 130 and the rotary safety ring 14. The cylindrical sheath 131, which should be flexible, encircles the neck (or only a portion of the neck) between the rotary safety ring and the circumferential shoulder. The cylindrical sheath 131 has an inside diameter not greater than the outside diameter of the circumferential shoulder 130. The sheath 131 abuts the shoulder 130 when the rotary safety ring 14, to which the sheath 131 is attached, is lowered to unlock the rotary safety ring 14 and thereby prevents the rotary safety ring from being unlocked as long as the sheath is positioned between the rotary safety ring and the circumferential shoulder 130. The sheath 131 has an inside longitudinal length such that any longitudinal space between the bottom edge of the sheath 131 and the top edge of the circumferential shoulder 130 is less than the longitudinal length of the rotary safety ring. That is, the longitudinal length of the cylindrical sheath 131 is sufficiently long to prevent the rotary safety ring from being lowered and thereby unlocked from the cap. Thus, as long as the cylindrical sheath 131 is about the neck of the container, then the rotary safety ring may not be unlocked.

The cylindrical sheath 131, which encircles at least a portion of the neck, is connected to the rotary safety ring 14 by at least one peel pin 132. The peel pin 132 is constructed to allow the sheath to be peeled from the rotary safety ring so that the sheath is no longer positioned between the rotary safety ring and the circumferential shoulder 130. The peel pin 132 tears as the sheath is peeled from the rotary safety ring. It will be observed that the cylindrical sheath 131 makes the closure 135 both tamper evident and tamper resistant since the closure cannot be opened as long as the sheath is positioned between the safety ring and the circumferential shoulder. The sheath must be removed before the closure can be opened and therefore, a missing sheath or a broken peel pin will indicate that the closure has been tampered with. Furthermore, if the sheath is peeled off without its providing any resistance, then the consumer will immediately know the closure has been tampered with. A peel tab 133 may be attached to the cylindrical sheath to allow the sheath to be peeled from the rotary safety ring. As shown in FIG. 24, the cylindrical sheath 131 encircles most of the neck between the rotary safety ring and the circumferential shoulder. However, a portion of a cylindrical sheath may be used rather than a sheath which forms a complete (i.e., 360 degree) circle. A cylindrical sheath 131 extending around the neck only 180 degrees (rather than 360 degrees) would probably function with the present invention. Generally, the cylindrical sheath 131 will have an inside diameter which is less than the outside diameter of the rotary safety ring 14. The sheath, as the one depicted in FIG. 24, may extend from the top edge of the circumferential shoulder to just below the bottom edge of the rotary safety ring 14. However, the sheath may be less than this in accordance with the present invention, provided that the longitudinal length of the sheath is sufficient to keep the rotary safety ring from being unlocked as long as the cylindrical sheath 131 is positioned between the ring 14 and the circumferential shoulder 130. While one may attach the cylindrical sheath 131 to the circumferential shoulder 130, such attachment, by, for example, a peel pin 132, is not necessary for the present invention to work.

It is preferable that a plurality of angularly spaced peel pins be provided for the closure 135. A plurality of angularly spaced peel pins connect the sheath to the rotary safety ring and, as noted before, allow the sheath 131 to be peeled from the rotary safety ring so that the sheath is no longer positioned between the rotary safety ring and the circumferential shoulder 130.

The peel pin, fragile tear pin, breakable arm and peg are particularly well suited to be constructed out of polyethylene, polystrene or aluminum since these materials allow pin-like objects to be breakable.

While a particular form of the invention has been described and illustrated, other modifications routinely made by those skilled in the art can be made without departing from the spirit and scope of the invention.

We claim:

1. A safety closure for a container having a rim defining a mouth, a neck located below said rim, and a peripheral lip around said rim, said closure comprising:

a snap cap having a top overlying said mouth and said rim and having a depending annular flange projecting below said top, said flange having an inwardly directed circumferential bead engaged below said lip, and a first outwardly directed circumferential bead located below said top and cooperating therewith to define a circumferential locking groove extending around the outer side of said flange;

a rotary safety ring having an annular sidewall surrounding said flange and overlying said locking groove and said first outwardly directed circumferential bead, said annular sidewall being closely spaced to said locking groove and said first outwardly directed circumferential bead so that said inwardly directed circumferential bead is held in engagement with said lip and prevents removal of said cap;

a plurality of angularly spaced fingers on the inner side of said sidewall projecting into said locking groove and overlying the bottom wall of said locking groove to prevent downward movement of said safety ring along said cap, said fingers being inclined inwardly and downwardly into said locking groove and having free inner ends positioned to be wedged against the bottom of the locking groove to prevent free flexing of the fingers as the safety ring is pulled downwardly relative to the cap, thereby normally preventing downward movement of said safety ring out of overlying relation with said locking groove;

a plurality of longitudinally extending release grooves in said first outwardly directed circumferential bead, spaced and sized to permit movement of said fingers through said first outwardly directed circumferential bead in one angular position of said safety ring about said cap, and thus allowing downward movement of said safety ring away from said cap for the removal of said cap from the container in said one angular position;

a locking member located below said rotary safety ring and having a first engaging means;

a second engaging means located on said neck and engaging said first engaging means so that said locking member cannot be rotated relative to said container;

a connection between said safety ring and said locking member preventing said safety ring from rotating, whereby, when said rotary safety ring is locked and out of alignment with said snap cap, said closure cannot be opened without breaking said connection.

2. A safety closure for a container having a rim defining a mouth, a neck located below said rim, and a peripheral lip around said rim, said closure comprising:

a snap cap having a top overlying said mouth and said rim and having a depending annular flange projecting below said top, said flange having an inwardly directed circumferential bead engaged below said lip, and a first outwardly directed circumferential bead located below said top and cooperating therewith to define a circumferential locking groove extending around the outer side of said flange;

a rotary safety ring having an annular sidewall surrounding said flange and overlying said locking groove and said first outwardly directed circumferential bead, said annular sidewall being closely spaced to said locking groove and said first outwardly directed circumferential bead so that said inwardly directed circumferential bead is held in engagement with said lip and prevents removal of said cap;

a plurality of angularly spaced fingers on the inner side of said sidewall projecting into said locking groove and overlying the bottom wall of said locking groove to prevent downward movement of said safety ring along said cap, said fingers being inclined inwardly and downwardly into said locking groove and having free inner ends positioned to be wedged against the bottom of the locking groove to prevent free flexing of the fingers as the safety ring is pulled downwardly relative to the cap, thereby normally preventing downward movement of said safety ring out of overlying relation with said locking groove;

a plurality of longitudinally extending release grooves in said first outwardly directed circumferential bead, spaced and sized to permit movement of said fingers through said first outwardly directed circumferential bead in one angular position of said safety ring about said cap, and thus allowing downward movement of said safety ring away from said cap for the removal of said cap from the container in said one angular position;

a portion of a second ring encircling a portion of said neck below said rotary safety ring, said portion of a second ring having a first engaging means;

at least one fragile tear pin connecting said portion of a second ring to said rotary safety ring, said fragile tear pin tearing when said rotary safety ring is rotated relative to said portion of a second ring;

a second engaging means located on said neck and engaging said first engaging means so that said portion of a second ring cannot be rotated relative to said container and resists rotation of said rotary safety ring relative to said portion of a second ring, whereby when said rotary safety ring is locked and out of alignment with said snap cap, said closure cannot be opened without tearing said fragile tear pin.

3. A safety closure for a container having a rim defining a mouth, a neck located below said rim, and a peripheral lip around said rim, said closure comprising:

a snap cap having a top overlying said mouth and said rim and having a depending annular flange projecting below said top, said flange having an inwardly directed circumferential bead engaged below said lip, and a first outwardly directed circumferential bead located below said top and cooperating therewith to define a circumferential locking groove extending around the outer side of said flange;

a rotary safety ring having an annular sidewall surrounding said flange and overlying said locking groove and said first outwardly directed circumferential bead, said annular sidewall being closely spaced to said locking groove and said first outwardly directed circumferential bead so that said inwardly directed circumferential bead is held in engagement with said lip and prevents removal of said cap;

a plurality of angularly spaced fingers on the inner side of said sidewall projecting into said locking groove and overlying the bottom wall of said locking groove to prevent downward movement of said safety ring along said cap, said fingers being inclined inwardly and downwardly into said locking groove and having free inner ends positioned to be wedged against the bottom of the locking groove to prevent free flexing of the fingers as the safety ring is pulled downwardly relative to the cap, thereby normally preventing downward movement of said safety ring out of overlying relation with said locking groove;

a plurality of longitudinally extending release grooves in said first outwardly directed circumferential bead, spaced and sized to permit movement of said fingers through said first outwardly directed circumferential bead in one angular position of said safety ring about said cap, and thus allowing downward movement of said safety ring away from said cap for the removal of said cap from the container in said one angular position;

a second ring encircling said neck below said rotary safety ring and having a plurality of inwardly directed teeth located on the inside edge of said second ring;

a plurality of angularly spaced fragile tear pins connecting said second ring to said rotary safety ring, said fragile tear pins tearing when said rotary safety ring is rotated relative to said second ring;

a plurality of outwardly directed teeth located on said neck and engaging said plurality of inwardly directed teeth so that said second ring cannot be rotated relative to said container and resists rotation of said rotary safety ring relative to said second ring;

whereby when said rotary safety ring is locked and out of alignment with said snap cap, said closure cannot be opened without tearing said fragile tear pins.

4. A safety closure for a container having a rim defining a mouth, a neck located below said rim, a peripheral lip around said neck, and a screw means for engaging a screw cap, said closure comprising:

said screw cap having a top overlying said mouth and said rim, and having a depending annular flange projecting below said top, said depending annular flange having a corresponding screw means for engaging said container and having an inwardly directed circumferential bead engaged below said lip and having a first outwardly directed circumferential bead located below said top and a second outwardly directed circumferential bead located above said first outwardly directed circumferential bead and cooperating therewith to define a circumferential locking groove extending around the outer side of said flange;

a rotary safety ring having an annular sidewall surrounding said flange and overlying said locking groove and said first outwardly directed circumferential bead, said annular sidewall being closely spaced to said locking groove and said first outwardly directed circumferential bead so that said inwardly directed bead is held in engagement with said lip and prevents removal of said screw cap;

a plurality of angularly spaced fingers on the inner side of said sidewall projecting into said locking groove and overlying the bottom wall of said locking groove to prevent downward movement of said safety ring along said cap, said fingers being inclined inwardly and downwardly into said locking groove and having free inner ends positioned to be wedged against the bottom of the locking groove to prevent free flexing of the fingers as the safety ring is pulled downwardly relative to said screw cap, thereby normally preventing downward movement of said safety ring out of overlying relation with said locking groove;

a plurality of longitudinally extending release grooves in said first outwardly directed circumferential bead, spaced and sized to permit movement of said fingers through said first outwardly directed circumferential bead in one angular position of said safety ring about said cap, and thus allowing downward movement of said safety ring away from said cap for the removal of the latter from the container in said one angular position;

a portion of a second ring encircling a portion of said neck below said rotary safety ring, said portion of a second ring having a first engaging means;

at least one fragile tear pin connecting said portion of a second ring to said rotary safety ring, said fragile tear pin tearing when said rotary safety ring is rotated relative to said portion of a second ring;

a second engaging means located on said neck and engaging said first engaging means so that said portion of a second ring cannot be rotated relative to said container and resists rotation of said rotary safety ring relative to said portion of a second ring, whereby when said rotary safety ring is locked and out of alignment with said screw cap, said closure cannot be opened without tearing said fragile tear pin.

5. A safety closure for a container having a rim defining a mouth, a neck located below said rim, a peripheral lip around said neck, and a screw means for engaging a screw cap, said closure comprising:

said screw cap having a top overlying said mouth and said rim, and having a depending annular flange projecting below said top, said depending annular flange having a corresponding screw means for engaging said container and having an inwardly directed circumferential bead engaged below said lip and having a first outwardly directed circumferential bead located below said top and a second outwardly directed circumferential bead located above said first outwardly dircted circumferential bead and cooperating therewith to define a circumferential locking groove extending around the outer side of said flange;

a rotary safety ring having an annular sidewall surrounding said flange and overlying said locking groove and said first outwardly directed circumferential bead, said annular sidewall being closely spaced to said locking groove and said first outwardly directed circumferential bead so that said inwardly directed bead is held in engagement with said lip and prevents removal of said screw cap;

a plurality of angularly spaced fingers on the inner side of said sidewall projecting into said locking groove and overlying the bottom wall of said locking groove to prevent downward movement of said safety ring along said cap, said fingers being inclined inwardly and downwardly into said locking groove and having free inner ends positioned to be wedged against the bottom of the locking groove to prevent free flexing of the fingers as the safety ring is pulled downwardly relative to said screw cap, thereby normally preventing downward movement of said safety ring out of overlying relation with said locking groove;

a plurality of longitudinally extending release grooves in said first outwardly directed circumferential bead, spaced and sized to permit movement of said fingers through said first outwardly directed circumferential bead in one angular position of said safety ring about said cap, and thus allowing downward movement of said safety ring away from said cap for the removal of the latter from the container in said one angular position;

a second ring encircling said neck below said rotary safety ring and having a plurality of inwardly directed teeth located on the inside edge of said second ring;

a plurality of angularly spaced fragile tear pins connecting said second ring to said rotary safety ring, said fragile tear pins tearing when said rotary safety ring is rotated relative to said second ring;

a plurality of outwardly directed teeth located on said neck and engaging said plurality of inwardly directed teeth so that said second ring cannot be rotated relative to said container and resists rotation of said rotary safety ring relative to said second ring;

whereby when said rotary safety ring is locked and out of alignment with said screw cap, said closure cannot be opened without tearing said fragile tear pins.

6. A safety closure for a container having a rim defining a mouth, a neck located below said rim, and a peripheral lip around said rim, said closure comprising:

a snap cap having a top overlying said mouth and said rim and having a depending annular flange projecting below said top, said flange having an inwardly directed circumferential bead engaged below said lip, and a first outwardly directed circumferential bead located below said top and cooperating therewith to define a circumferential locking groove extending around the outer side of said flange;

a rotary safety ring having an annular sidewall surrounding said flange and overlying said locking groove and said first outwardly directed circumferential bead, said annular sidewall being closely spaced to said locking groove and said first outwardly directed circumferential bead so that said inwardly directed circumferential bead is held in engagement with said lip and prevents removal of said cap;

a plurality of angularly spaced fingers on the inner side of said sidewall projecting into said locking groove and overlying the bottom wall of said locking groove to prevent downward movement of said safety ring along said cap, said fingers being inclined inwardly and downwardly into said locking groove and having free inner ends positioned to be wedged against the bottom of the locking groove to prevent free flexing of the fingers as the safety ring is pulled downwardly relative to the cap, thereby normally preventing downward movement of said safety ring out of overlying relation with said locking groove;

a plurality of longitudinally extending release grooves in said first outwardly directed circumferential bead, spaced and sized to permit movement of said fingers through said first outwardly directed circumferential bead in one angular position of said safety ring about said cap, and thus allowing downward movement of said safety ring away from said cap for the removal of said cap from the container in said one angular position;

a portion of a tear strip encircling a portion of said neck below said rotary safety ring, said portion of a tear strip having a first engaging means;

at least one peel pin connecting said portion of a tear strip to said rotary safety ring, said peel pin being resistant to breaking when said rotary safety ring is rotated relative to said portion of a tear strip but allowing said portion of a tear strip to be peeled from said rotary safety ring;

a second engaging means located on said neck and engaging said first engaging means so that said portion of a tear strip cannot be rotated relative to said container and prevents rotation of said rotary safety ring, whereby when said rotary safety ring is locked and out of alignment with said snap cap, said closure cannot be opened without peeling said portion of a tear strip from said rotary safety ring.

7. A safety closure for a container having a rim defining a mouth, a neck located below said rim, and a peripheral lip around said rim, said closure comprising:

a snap cap having a top overlying said mouth and said rim and having a depending annular flange projecting below said top, said flange having an inwardly directed circumferential bead engaged below said lip, and a first outwardly directed circumferential bead located below said top and cooperating therewith to define a circumferential locking groove extending around the outer side of said flange;

a rotary safety ring having an annular sidewall surrounding said flange and overlying said locking groove and said first outwardly directed circumferential bead, said annular sidewall being closely spaced to said locking groove and said first outwardly directed circumferential bead so that said inwardly directed circumferential bead is held in engagement with said lip and prevents removal of said cap;

a plurality of angularly spaced fingers on the inner side of said sidewall projecting into said locking groove and overlying the bottom wall of said locking groove to prevent downward movement of said safety ring along said cap, said fingers being inclined inwardly and downwardly into said locking groove and having free inner ends positioned to be wedged against the bottom of the locking groove to prevent free flexing of the fingers as the safety ring is pulled downwardly relative to the cap, thereby normally preventing downward movement of said safety ring out of overlying relation with said locking groove;

a plurality of longitudinally extending release grooves in said first outwardly directed circumferential bead, spaced and sized to permit movement of said fingers through said first outwardly directed circumferential bead in one angular position of said safety ring about said cap, and thus allowing downward movement of said safety ring away from said cap for the removal of said cap from the container in said one angular position;

a tear strip encircling said neck below said rotary safety ring and having a plurality of inwardly directed teeth located on the inside edge of said tear strip;

a plurality of angularly spaced peel pins connecting said tear strip to said rotary safety ring, said peel pins being resistant to breaking when said rotary safety ring is rotated relative to said tear strip but allowing said tear strip to be peeled from said rotary safety ring;

a plurality of outwardly directed teeth located on said neck and engaging said plurality of inwardly directed teeth so that said tear strip cannot be rotated relative to said container and prevents rotation of said rotary safety ring, whereby when said rotary safety ring is locked and out of alignment with said snap cap, said closure cannot be opened without peeling said tear strip from said rotary safety ring.

8. A safety closure as defined in claim 7, further comprising:

a peel tab attached to said tear strip and allowing said tear strip to be peeled from said rotary safety ring.

9. A safety closure for a container having a rim defining a mouth, a neck located below said rim, a peripheral lip around said neck, and a screw means for engaging a screw cap, said closure comprising:

said screw cap having a top overlying said mouth and said rim, and having a depending annular flange projecting below said top, said depending annular flange having a corresponding screw means for engaging said container and having an inwardly directed circumferential bead engaged below said lip and having a first outwardly directed circumferential bead located below said top and a second outwardly directed circumferential bead located above said first outwardly directed circumferential bead and cooperating therewith to define a circumferential locking groove extending around the outer side of said flange;

a rotary safety ring having an annular sidewall surrounding said flange and overlying said locking groove and said first outwardly directed circumferential bead, said annular sidewall being closely spaced to said locking groove and said first outwardly directed circumferential bead so that said inwardly directed bead is held in engagement with said lip and prevents removal of said screw cap;

a plurality of angularly spaced fingers on the inner side of said sidewall projecting into said locking groove and overlying the bottom wall of said locking groove to prevent downward movement of said safety ring along said cap, said fingers being inclined inwardly and downwardly into said locking groove and having free inner ends positioned to be wedged against the bottom of the locking groove to prevent free flexing of the fingers as the safety ring is pulled downwardly relative to said screw cap, thereby normally preventing downward movement of said safety ring out of overlying relation with said locking groove;

a plurality of longitudinally extending release grooves in said first outwardly directed circumferential bead, spaced and sized to permit movement of said fingers through said first outwardly directed circumferential bead in one angular position of said safety ring about said cap, and thus allowing downward movement of said safety ring away from said cap for the removal of the latter from the container in said one angular position;

a portion of a tear strip encircling a portion of said neck below said rotary safety ring, said portion of a tear strip having a first engaging means;

at least one peel pin connecting said portion of a tear strip to said rotary safety ring, said peel pin being resistant to breaking when said rotary safety ring is rotated relative to said portion of a tear strip, but allowing said portion of a tear strip to be peeled from said rotary safety ring;

a second engaging means located on said neck and engaging said first engaging means so that said portion of a tear strip cannot be rotated relative to said container and prevents rotation of said rotary safety ring, whereby when said rotary safety ring is locked and out of alignment with said screw can, said closure cannot be opened without peeling said portion of a tear strip from said rotary safety ring.

10. A safety closure for a container having a rim defining a mouth, a neck located below said rim, a peripheral lip around said neck, and a screw means for engaging a screw cap, said closure comprising:

said screw cap having a top overlying said mouth and said rim, and having a depending annular flange projecting below said top, said depending annular flange having a corresponding screw means for engaging said container and having an inwardly directed circumferential bead engaged below said lip and having a first outwardly directed circumferential bead located below said top and a second outwardly directed circumferential bead located above said first outwardly directed circumferential bead and cooperating therewith to define a circumferential locking groove extending around the outer side of said flange;

a rotary safety ring having an annular sidewall surrounding said flange and overlying said locking groove and said first outwardly directed circumferential bead, said annular sidewall being closely spaced to said locking groove and said first outwardly directed circumferential bead so that said inwardly directed bead is held in engagement with said lip and prevents removal of said screw cap;

a plurality of angularly spaced fingers on the inner side of said sidewall projecting into said locking groove and overlying the bottom wall of said locking groove to prevent downward movement of said safety ring along said cap, said fingers being inclined inwardly and downwardly into said locking groove and having free inner ends positioned to be wedged against the bottom of the locking groove to prevent free flexing of the fingers as the safety ring is pulled downwardly relative to said screw cap, thereby normally preventing downward movement of said safety ring out of overlying relation with said locking groove;

a plurality of longitudinally extending release grooves in said first outwardly directed circumferential bead, spaced and sized to permit movement of said fingers through said first outwardly directed circumferential bead in one angular position of said safety ring about said cap, and thus allowing downward movement of said safety ring away from said cap for the removal of the latter from the container in said one angular position;

a tear strip encircling said neck below said rotary safety ring and having a plurality of inwardly directed teeth located on the inside edge of said tear strip;

a plurality of angularly spaced peel pins connecting said tear strip to said rotary safety ring, said peel pins being resistant to breaking when said rotary safety ring is rotated relative to said tear strip but allowing said tear strip to be peeled from said rotary safety ring;

a peel tab attached to said tear strip and allowing said tear strip to be peeled from said rotary safety ring, whereby when said rotary safety ring is locked and out of alignment with said screw cap, said closure cannot be opened without peeling said tear strip from said rotary safety ring.

11. A safety closure for a container having a rim defining a mouth, a neck located below said rim, and a peripheral lip around said rim, said closure comprising:

a snap cap having a top overlying said mouth and said rim and having a depending annular flange projecting below said top, said flange having an inwardly directed circumferential bead engaged below said lip and having an outwardly directed thumb tab extending around a portion of said depending annular flange and located at the bottom edge of said depending annular flange;

an annular ridge located on said neck below the bottom edge of said depending annular flange, said annular ridge extending outwardly from said neck at least as far as said outwardly directed thumb tab, said annular ridge having an indented portion allowing said outwardly directed thumb tab to extend outwardly beyond said indented portion of said annular ridge when said thumb tab is positioned over said indented portion so that the underside of said outwardly directed thumb tab is exposed only when said thumb tab is positioned over said indented portion, said annular ridge preventing removal of said snap cap from said container unless said thumb tab is positioned over said indented portion;

a portion of a snap-off ring encircling a portion of said neck and having a first engaging means;

at least one breakable arm connecting said portion of a snap-off ring to said snap cap; and a second engaging means located on said annular ridge and engaging said first engaging means so that said portion of a snap-off ring cannot be rotated relative to said container and resists rotation of said snap cap, whereby said snap cap cannot be rotated without breaking said breakable arm.

12. A safety closure as defined in claim 11, wherein said portion of a snap-off ring extends under said annular ridge and said first engaging means is a plurality of upwardly extending teeth located on the inside edge of said portion of a snap-off ring, and wherein said second engaging means is a plurality of teeth which extend substantially downwardly from the underside of said annular ridge thereby preventing upward movement of said portion of a snap-off ring, and wherein said snap cap is placed so that no portion of said thumb tab is positioned over said indented portion, whereby said closure cannot be opened without breaking said breakable arm.

13. A safety closure as defined in claim 12, wherein two breakable arms connect said portion of a snap-off ring to said snap cap and each of said two breakable arms is fragile enough that each of said breakable arms is broken by rotating said snap cap relative to said portion of a snap-off ring, and wherein said portion of a snap-off ring encircles most of said neck.

14. A safety closure for a container having a rim defining a mouth, a neck located below said rim, and a peripheral lip around said rim, said closure comprising:

a snap cap having a top overlying said mouth and said rim and having a depending annular flange projecting below said top, said flange having an inwardly directed circumferential bead engaged below said lip and having an outwardly directed thumb tab extending around a portion of said depending annular flange and located at the bottom edge of said depending annular flange;

an annular ridge located on said neck below the bottom edge of said depending annular flange, said annular ridge extending outwardly from said neck at least as far as said outwardly directed thumb tab, said annular ridge having an indented portion allowing said outwardly directed thumb tab to extend outwardly beyond said indented portion of said annular ridge when said thumb tab is positioned over said indented portion so that the underside of said outwardly directed thumb tab is exposed only when said thumb tab is positioned over said indented portion, said annular ridge preventing removal of said snap cap from said container unless said thumb tab is positioned over said indented portion;

a portion of a snap-off ring encircling a portion of said neck and having a first engaging means;

at least one peg connecting said portion of a snap-off ring to said snap cap, said peg being resistant to breaking but allowing said portion of a snap off ring to be peeled from said peg; and a second engaging means located on said annular ridge and engaging said first engaging means so that said portion of a snap-off ring cannot be rotated relative to said container and prevents rotation of said snap cap, whereby said snap cap cannot be rotated without removing said portion of a snap off ring.

15. A safety closure as defined in claim 14, wherein said portion of a snap-off ring extends under said annular ridge and said first engaging means is a plurality of upwardly extending teeth located on the inside edge of said portion of a snap-off ring, and wherein said second engaging means is a plurality of teeth which extend substantially downwardly from the underside of said annular ridge thereby preventing upward movement of said portion of a snap-off ring, and wherein said snap cap is placed so that no portion of said thumb tab is positioned over said indented portion, whereby said closure cannot be opened without peeling said portion of a snap-off ring from said closure.

16. A safety closure as defined in claim 15, further comprising:

a rip tab attached to said portion of a snap-off ring and allowing said portion of a snap-off ring to be peeled from said closure, thereby allowing said closure to be opened.

17. A safety closure as defined in claim 16, wherein said portion of a snap-off ring encircles most of said neck and wherein two pegs connect said portion of a snap-off ring to said snap cap.

18. A safety closure for a container having a rim defining a mouth, a neck located below said rim, and a peripheral lip around said rim, said closure comprising:

a snap cap having a top overlying said mouth and said rim and having a depending annular flange projecting below said top, said flange having an inwardly directed circumferential bead engaged below said lip, and a first outwardly directed circumferential bead located below said top and cooperating therewith to define a circumferential locking groove extending around the outer side of said flange;

a rotary safety ring having an annular sidewall surrounding said flange and overlying said locking groove and said first outwardly directed circumferential bead, said annular sidewall being closely spaced to said locking groove and said first outwardly directed circumferential bead so that said inwardly directed circumferential bead is held in engagement with said lip and prevents removal of said cap;

a plurality of angularly spaced fingers on the inner side of said sidewall projecting into said locking groove and overlying the bottom wall of said locking groove to prevent downward movement of said safety ring along said cap, said fingers being inclined inwardly and downwardly into said locking groove and having free inner ends positioned to be wedged against the bottom of the locking groove to prevent free flexing of the fingers as the safety ring is pulled downwardly relative to the cap, thereby normally preventing downward movement of said safety ring out of overlying relation with said locking groove;

a plurality of longitudinally extending release grooves in said first outwardly directed circumferential bead, spaced and sized to permit movement of said fingers through said first outwardly directed circumferential bead in one angular position of said safety ring about said cap, and thus allowing downward movement of said safety ring away from said cap for the removal of said cap from the container in said one angular position;

a circumferential shoulder attached to said neck below said rotary safety ring and projecting outwardly from said neck and surrounding said neck;

a cylindrical sheath encircling a portion of said neck below said rotary safety ring, said sheath being located above said circumferential shoulder and having an inside diameter not greater than the outside diameter of said circumferential shoulder and having an inside longitudinal length such that any longitudinal space between the bottom edge of said sheath and the top edge of said circumferential shoulder is less than the longitudinal length of said rotary safety ring, said sheath abutting said shoulder when said safety ring is lowered to unlock said ring thereby preventing said rotary safety ring from being unlocked as long as said sheath is positioned between said safety ring and said circumferential shoulder;

at least one peel pin connecting said sheath to said rotary safety ring, said peel pin allowing said sheath to be peeled from said rotary safety ring so that said sheath is not positioned between said safety ring and said circumferential shoulder, said peel pin tearing as said sheath is peeled from said safety ring;

whereby said closure cannot be opened as long as said sheath is positioned between said safety ring and said circumferential shoulder.

19. A safety closure as defined in claim 18, wherein the inside diameter of said sheath is less than the outside diameter of said rotary safety ring, and further comprising:

a peel tab attached to said cylindrical sheath and allowing said sheath to be peeled from said rotary safety ring, whereby said closure cannot be opened without peeling said sheath from said rotary safety ring.

20. A safety closure for a container having a rim defining a mouth, a neck located below said rim, and a peripheral lip around said rim, said closure comprising:

a snap cap having a top overlying said mouth and said rim and having a depending annular flange projecting below said top, said flange having an inwardly directed circumferential bead engaged below said lip, and a first outwardly directed circumferential bead located below said top and cooperating therewith to define a circumferential locking groove extending around the outer side of said flange;

a rotary safety ring having an annular sidewall surrounding said flange and overlying said locking groove and said first outwardly directed circumferential bead, said annular sidewall being closely spaced to said locking groove and said first outwardly directed circumferential bead so that said inwardly directed circumferential bead is held in engagement with said lip and prevents removal of said cap;

a plurality of angularly spaced fingers on the inner side of said sidewall projecting into said locking groove and overlying the bottom wall of said locking groove to prevent downward movement of said safety ring along said cap, said fingers being inclined inwardly and downwardly into said locking groove and having free inner ends positioned to be wedged against the bottom of the locking groove to prevent free flexing of the fingers as the safety ring is pulled downwardly relative to the cap, thereby normally preventing downward movement of said safety ring out of overlying relation with said locking groove;

a plurality of longitudinally extending release grooves in said first outwardly directed circumferential bead, spaced and sized to permit movement of said fingers through said first outwardly directed circumferential bead in one angular position of said safety ring about said cap, and thus allowing downward movement of said safety ring away from said cap for the removal of said cap from the container in said one angular position;

a circumferential shoulder attached to said neck below said rotary safety ring and projecting outwardly from said neck and surrounding said neck;

a cylindrical sheath encircling most of said neck between said rotary safety ring and said circumferential shoulder, said sheath being located above said circumferential shoulder and below said safety ring and having an inside diameter less than the outside diameter of said circumferential shoulder and less than the outside diameter of said rotary safety ring, said sheath extending from the top edge of said circumferential shoulder to just below the bottom edge of said safety ring, thereby preventing said rotary safety ring from being unlocked as long as said sheath is positioned between said safety ring and said circumferential shoulder;

a plurality of angularly spaced peel pins connecting said sheath to said rotary safety ring, said peel pins allowing said sheath to be peeled from said rotary safety ring, said peel pins tearing as said sheath is peeled from said safety ring;

a peel tab attached to said cylindrical sheath and allowing said sheath to be peeled from said rotary safety ring, whereby said closure cannot be opened without peeling said sheath from said rotary safety ring.

* * * * *